United States Patent [19]

Morigaki et al.

[11] Patent Number: 4,868,101

[45] Date of Patent: Sep. 19, 1989

[54] SILVER HALIDE COLOR PHOTOGRAPHIC MATERIAL

[75] Inventors: Masakazu Morigaki; Nobuo Seto, both of Minami-ashigara, Japan

[73] Assignee: Fuji Photo Film Co., Ltd., Kanagawa, Japan

[21] Appl. No.: 53,122

[22] Filed: May 22, 1987

[30] Foreign Application Priority Data

May 22, 1986 [JP] Japan ..... 61-116081

[51] Int. Cl.[4] ..... G03C 1/06; G03C 7/34; G03C 7/36; G03C 7/38

[52] U.S. Cl. ..... 430/551; 430/552; 430/553; 430/554; 430/555; 430/556; 430/557; 430/558

[58] Field of Search ..... 430/551, 372, 552, 554, 430/556, 558

[56] References Cited

U.S. PATENT DOCUMENTS 3,764,337 12/1973 Arai et al. .
3,930,866 1/1976 Oishi et al. ..... 430/551
4,113,488 8/1978 Yamada et al. .
4,268,621 5/1981 Ogi et al. ..... 430/551
4,332,886 6/1982 Aoki et al. ..... 430/551
4,360,589 3/1982 Kojima et al. .
4,559,297 12/1985 Seto et al. ..... 430/551
4,623,617 11/1986 Kaneko et al. ..... 430/558

FOREIGN PATENT DOCUMENTS 44521 1/1979 Japan .

*Primary Examiner*—Paul R. Michl
*Assistant Examiner*—Mark R. Buscher
*Attorney, Agent, or Firm*—Birch, Stewart Kolasch & Birch

[57] ABSTRACT

A silver halide color photographic material, wherein a dye stabilizer as described in the claims is contained in a photographic layer such as a coupler-containing silver halide photosensitive emulsion layer. The dye images obtained eventually by developing the photographic material is excellent in preventing it from fading or discoloring.

14 Claims, No Drawings

SILVER HALIDE COLOR PHOTOGRAPHIC MATERIAL

BACKGROUND OF THE INVENTION (1) Field of the Invention

The present invention relates to a color photographic material, particularly to the prevention of fading and discoloring of the dye image eventually obtained by developing a color photographic material, and more particularly to a dibenzospiroindane type fading preventive agent.

(2) Description of the Prior Art

Generally, a dye image obtained by subjecting a silver halide color photographic material to photographic processing is made up of an azomethine dye or an indoaniline dye formed by a reaction of a coupler with the oxidation product of an aromatic primary amine developing agent. The color photographic images obtained in this manner are not necessarily stable to light and moist heat, and when the color photographic images are exposed to light for a prolonged period of time or are preserved under high temperatures and high humidities, the dye images may be faded or discolored, resulting in deterioration of the image quality.

The fading of images is an almost fatal disadvantage to recording materials. In order to obviate this disadvantage, there have been made such proposals that a coupler low in fading is used, a fading preventive agent for preventing fading due to light be used, and an ultraviolet absorbing agent for preventing the images from being deteriorated by ultraviolet light be used.

Among others, the image deterioration preventive effect by fading preventive agents is great, and as examples of such agents are known hydroquinones, hindered phenols, tocopherols, chromans, coumarans, ethers or esters obtained by sililating, acylating or alkylating the phenolic hydroxyl group of these compounds, and metal complexes (e.g., U.S. Pat. Nos. 3,935,016, 3,982,944, 4,254,216 and 3,700,455, and British Pat. No. 2,066,975, U.S. Pat. Nos. 3,336,135, 4,268,593, 3,432,300, 3,574,627, 3,573,050 and 4,155,765, Japanese Patent Publication No. 12337/1979, U.S. Pat. Nos. 4,050,938 and 4,241,155, Japanese patent application (OPI) No. 97353/1985, etc.).

Although these compounds are recognized as preventing a color image from fading or discoloring, they are unsatisfactory to meet the needs of users who want a high quality image, and they have not yet attained excellent effectiveness for color photography in general because they change the hue, or cause fog or a defective dispersion, or because fine crystals are formed after the application of the emulsion.

On the other hand, fading preventive agents with a spiro ring attract interest because they have unique structures and are highly effective in preventing fading. Examples are spirochromans (e.g., U.S. Pat. Nos. 3,764,337 and 4,174,220) and spiroindanes (e.g., U.S. Pat. Nos. 4,360,589 and 4,416,978, British Pat. No. 2,135,788A, and Japanese patent application (OPI) Nos. 204035/1982, 204037/1982 and 6652/1986). Although they prevent fading, nowadays they are not satisfactory since techniques have progressed and more highly fast images are required.

BRIEF SUMMARY OF THE INVENTION

An object of the present invention is to provide a color photographic material in which the color image obtained therefrom will not discolor for a long period of time, the yellow stain of the white background of the color image is suppressed remarkably and therefore the color image has high preservability.

A further object of the present invention is to provide a photographic fading preventive agent that will not cause change of the hue or fogging, has an enough of an effect for preventing a color image from fading or discoloring, and will not form fine crystals after being applied.

Another object of the invention is to provide a fading preventive agent for color photography that is excellent in solubility in high boiling point solvents or the like, would not allow fine crystals to form before or after the application, and would not adversely affect other additives for photography.

Other and further objects, features and advantages of the invention will appear more fully from the following description.

DETAILED DESCRIPTION OF THE INVENTION

As a result of extensive research, the inventors have found that when at least one of the compounds having general formula (I) given below is contained in a photographic layer of a silver halide color photographic material, the objects of the present invention can be attained.

General formula (I)

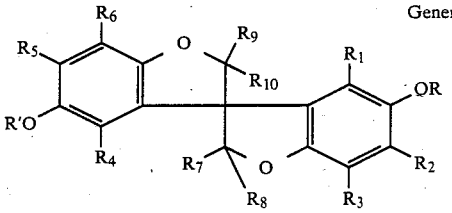

wherein R and R', which may be the same or different, each represent a hydrogen atom, alkyl group, alkenyl group, aryl group, heterocyclic ring group, $R_{11}CO$—, $R_{12}SO_2$—, $R_{13}NHCO$— in which $R_{11}$, $R_{12}$ and $R_{13}$ each represent an alkyl group, alkenyl group, aryl group or heterocyclic group, $R_1$, $R_2$, $R_3$, $R_4$, $R_5$ and $R_6$, which may be the same or different, each represent a hydrogen atom, halogen atom, alkyl group, alkenyl group, alkoxy group, alkenoxy group, aryloxy group, alkylthio group, alkenylthio group, arylthio group, alkoxycarbonyl group, alkylcarbonyl group, hydroxy group, alkylcarbonyloxy group, carbamoyl group or acylamino group, $R_7$, $R_8$, $R_9$ and $R_{10}$, which may be the same or different, each represent a hydrogen atom, alkyl group, alkenyl group, alkoxy group, alkenoxy group, aryloxy group, alkylthio group, alkenylthio group or arylthio group, R and $R_1$ or $R_2$ may be joined together to form a 5 or 6-membered ring, and R' and $R_4$ or $R_5$ may be joined together to form a 5 or 6-membered ring.

In general formula (I), the number of carbon atoms of the alkyl or alkenyl portion in each R, R' and $R_1 \sim R_{10}$ is preferably $1 \sim 20$.

Substituents represented by general formula (I) are further described in detail.

In general formula (I), R and R', which may be the same or different, each represent a hydrogen atom, alkyl group (e.g., methyl, ethyl, propyl, n-octyl, tert-octyl, benzyl or hexadecyl), alkenyl group (e.g., allyl, octenyl or oleyl), aryl group (e.g., phenyl or naphthyl), heterocyclic ring (e.g., tetrahydrophranyl or pyrimidyl), $R_{11}CO$, $R_{12}SO_2$ or $R_{13}NHCO$ in which $R_{11}$, $R_{12}$ and $R_{13}$ each represent an alkyl group (e.g., methyl, ethyl, n-propyl, n-butyl, n-octyl, tert-octyl or benzyl), alkenyl group (e.g., allyl, octenyl or oleyl), aryl group (e.g., phenyl, methoxyphenyl or naphthyl) or heterocyclic ring (e.g., pyridyl or pyrimidyl). R and R' each may represent a silyl group (e.g., trimethylsilyl, dimethylphenylsilyl, dimethyl-t-butylsilyl or triphenylsilyl).

$R_1$, $R_2$, $R_3$, $R_4$, $R_5$ and $R_6$, which may be the same or different, each represent a hydrogen atom, halogen atom (e.g., fluorine, chlorine or bromine), alkyl group (e.g., methyl, ethyl, n-butyl and benzyl), alkenyl group (e.g., allyl, hexenyl or octenyl), alkoxy group (e.g., methoxy, ethoxy or benzyloxy), alkenoxy (e.g., 2-propenyloxy or hexenyloxy), aryloxy group (e.g., phenyloxy or naphthyloxy), alkylthio group (e.g., ethylthio or butylthio), alkenylthio group (e.g., 2-butenylthio or 2-pentenylthio), arylthio group (e.g., phenylthio or naphthylthio), alkoxycarbonyl group (e.g., methoxycarbonyl group or butoxycarbonyl group), alkylcarbonyl group (e.g., acetyl or tetradecanoyl), hydroxy group, alkylcarbonyloxy group (e.g., acetyloxy or tetradecanoyloxy), carbamoyl group (e.g., N-ethylcarbamoyl or N-methyl-N-dodecylcarbamoyl) or acylamino group (e.g., acetylamino or benzamino).

$R_7$, $R_8$, $R_9$ and $R_{10}$, which may be the same or different, each represent a hydrogen atom, alkyl group (e.g., methyl, ethyl or n-butyl), alkenyl group (e.g., allyl or octenyl), alkoxy group (e.g., methoxy or butoxy), alkenoxy group (e.g., 2-propenyloxy or hexenyloxy), aryloxy group (e.g., phenyloxy or naphthyloxy), alkylthio group (e.g., ethylthio or butylthio), alkenylthio group (e.g., 2-butenylthio or 2-pentenylthio) or arylthio group (e.g., phenylthio or naphthylthio).

Of compounds represented by general formula (I) according to the present invention, and in view of the intended effect, those compounds are preferable wherein $R_7$, $R_8$, $R_9$ and $R_{10}$ each represent a hydrogen atom and particularly R and R' together represent a combination of a hydrogen atom and alkyl.

When a compound represented by general formula (I) according to the invention is used in combination with a known fading preventive agent, the effect is further enhanced. Similarly, two or more compounds represented by general formula (I) may be used together.

Although the amount of a compound represented by general formula (I) used in the present invention depends on the type of coupler, it is generally suitable that the amount used be in the range of from 0.5 to 200 wt. %, preferably from 2 to 150 wt. % for the coupler.

Typical examples of these compounds are given below which does not intend to limit the present invention.

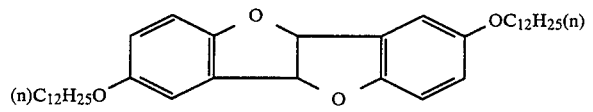

(1)

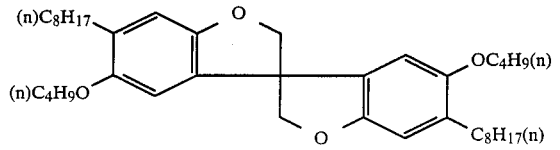

(2)

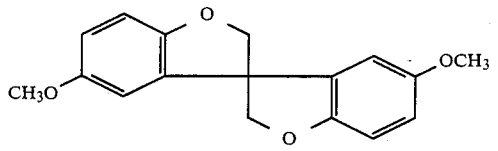

(3)

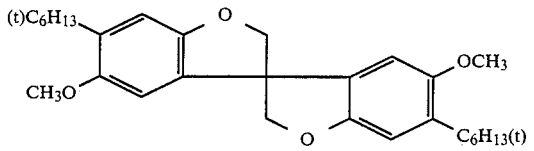

(4)

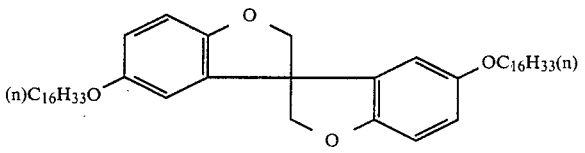

(5)

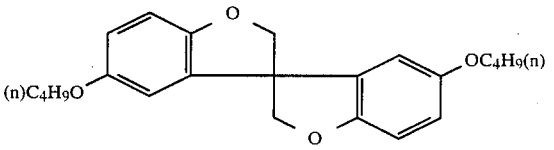

(6)

-continued
(7)
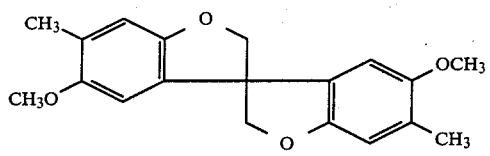
(8)
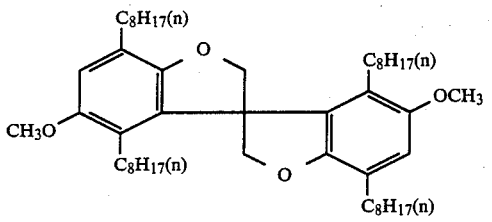
(9)
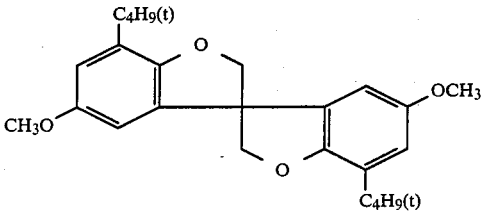
(11)
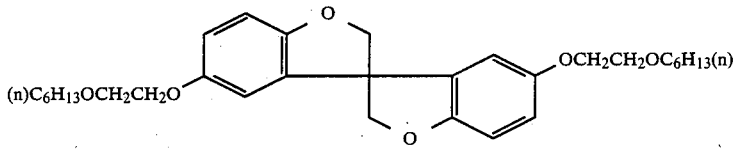
(12)
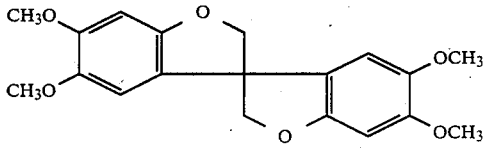
(13)
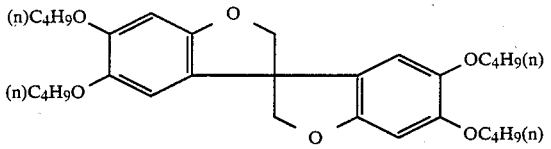
(14)
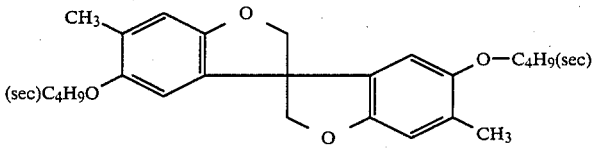
(15)
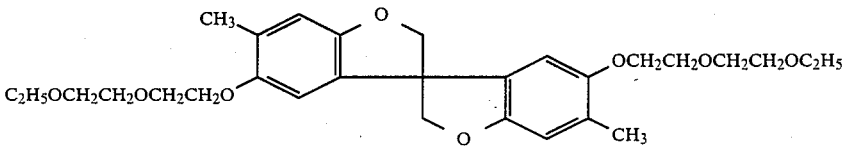
(16)
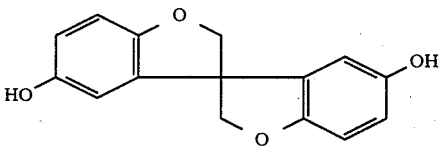

-continued
(17)
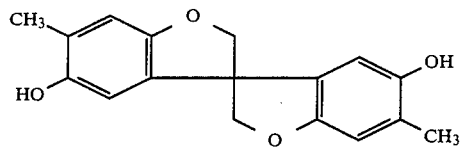
(18)
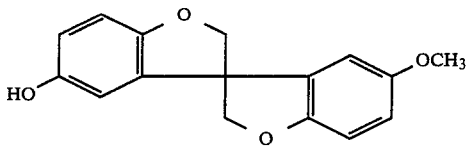
(19)
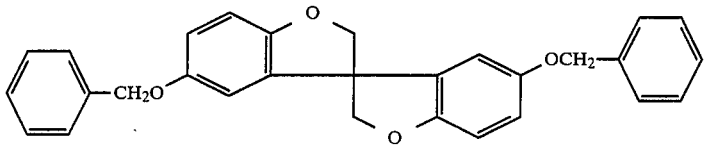
(20)
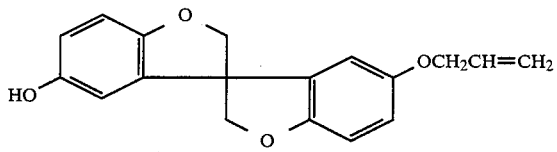
(21)
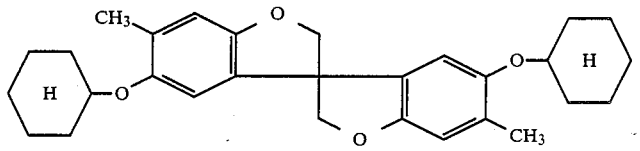
(22)
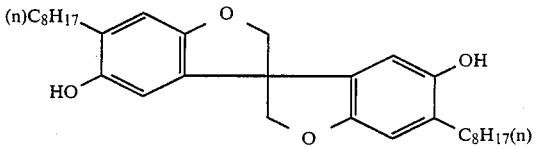
(23)
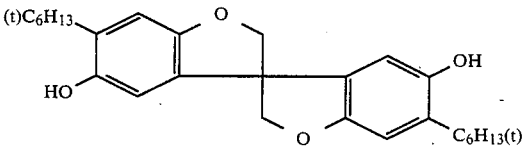
(24)
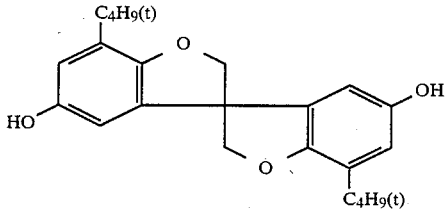
(25)
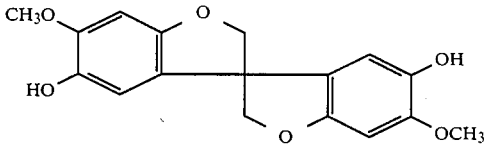

-continued
(26)
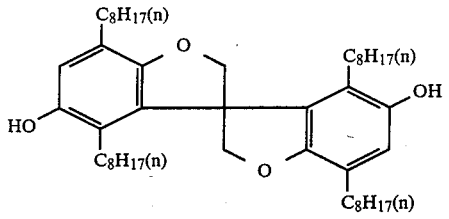
(27)
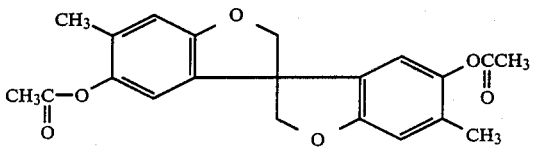
(28)
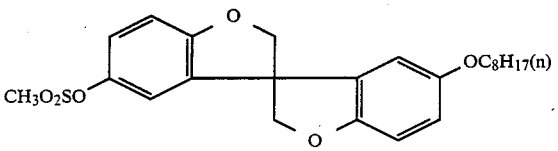
(29)
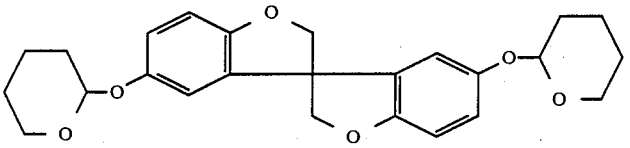
(30)
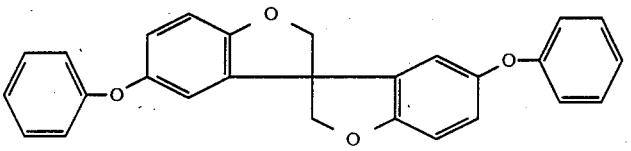
(31)
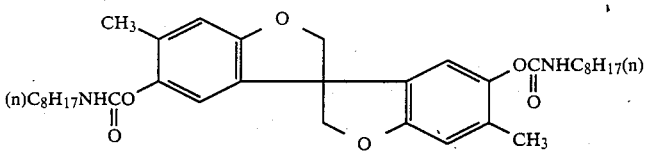
(32)
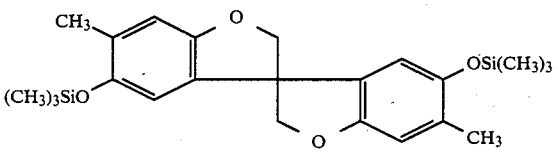
(33)
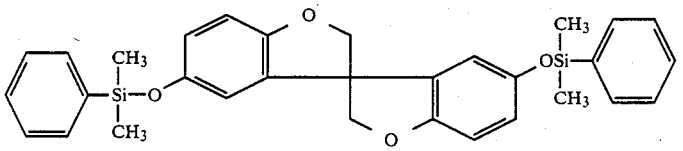
(34)
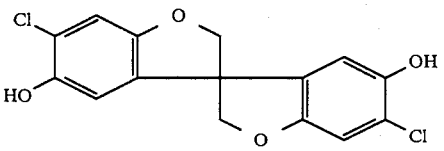

-continued
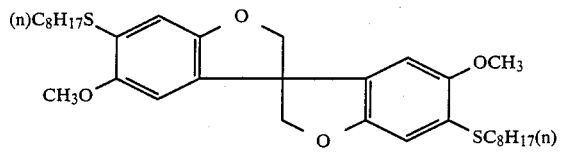
(35)
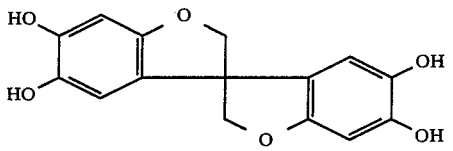
(36)
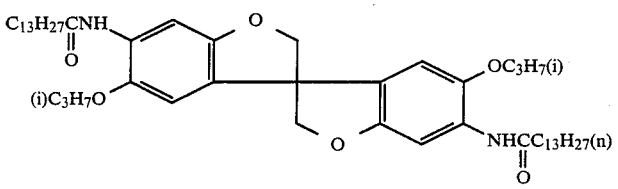
(37)
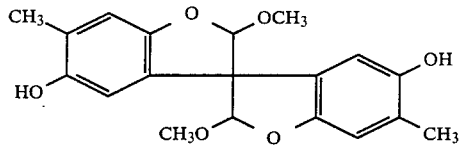
(38)
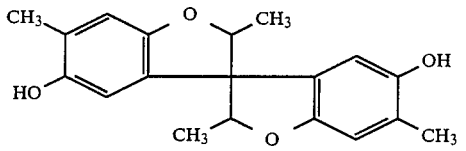
(39)
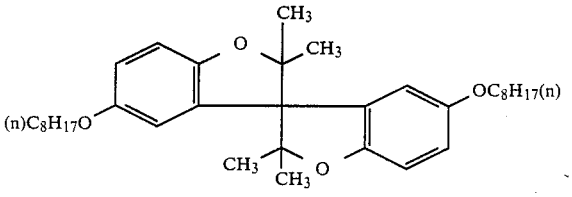
(40)
Now, a process for the preparation of 3,3'(2H, 2'H)-spirobibenzofuran derivatives represented by general formula (I) according to the present invention is described. 3,3'(2H, 2'H)-spirobibenzofuran derivatives represented by general formula (I) can be synthesized in the following steps or in a manner similar thereto.
Synthesis scheme
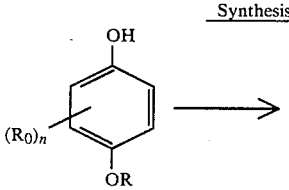
1
-continued
Synthesis scheme
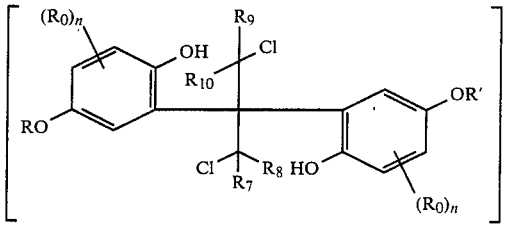
2
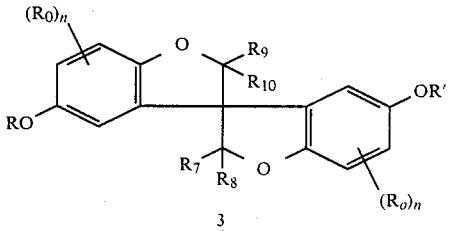
3

Wherein R, R', $R_7$, $R_8$, $R_9$ and $R_{10}$ have the same meaning as defined above, $R_0$ represents the same substituent as defined in $R_1$ to $R_6$, and n is an integer of from 0 to 3.

To produce a compound represented by general formula (I), a p-alkoxyphenol analogue 1 is reacted with a 1,3-dihalogen-2-propane derivative to obtain Compound 2. Compound 2 is subjected to an intramolecular ring closure reaction to obtain a 3,3'(2H,2H')-spirobibenzofuran 3 derivative.

Synthesis Examples of representative compounds are given below.

Synthesis of 5,5'-dimethoxy-3,3'(2H,2'H)-spirobibenzofuran (Exemplified Compound (3))

100 ml of methylene chloride was added to 37.2 g (0.30 mol) of p-methoxyphenol. Then, 19 g (0.15 mol) of 1,3-dichloro-2-propanone was dissolved therein, and the mixture was stirred at 0° to 5° C. 9 ml of concentrated sulfuric acid was then added dropwise over 1 hour, and the mixture was thereafter stirred for 2 hours. The reaction mixture was poured into 200 mol of ice water, and 200 ml of methylene chloride was added to effect extraction. The extract was washed twice with 300 ml of cold water, and then dried over calcium chloride. After the calcium chloride was filtered off, the methylene chloride was distilled off under reduced pressure, and the unreacted raw materials were quickly removed by column chromatography from the resulting oil. 100 ml of benzene were added to the oil obtained, and the mixture was stirred at 15° to 20° C., then 2 g (0.083 mol) of sodium hydride was gradually added. After stirring for a 1 hour further, the mixture was cooled to 0° to 10° C., and 20 ml of methanol was added dropwise over 10 min while stirring. The reaction mixture was poured into 200 ml of ice water containing 7 ml of concentrated hydrochloric acid. Then, 100 ml of ethyl acetate was added to effect extraction, and, after the extract was washed twice with 200 ml of cold water, the extract was dried over anhydrous sodium sulfate. After the sodium sulfate was filtered off, the ethyl acetate was distilled off under reduced pressure, and the resulting oil was purified by column chromatography. Crystalization of the result from 40 ml of methanol was carried out, and recrystalization from 40 ml of methanol was effected to obtain 9.4 g of Exemplified Compound (3). Yield: 22%; m.p: 179° to 180° C.

| Analysis | C | H |
|---|---|---|
| Found | 71.78% | 5.64% |
| Calculated for $C_{17}H_{16}O_4$ | 71.82% | 5.67% |

Synthesis of 5,5'-dimethoxy-6,6'-dimethyl-3,3'(2H,2H')-spirobenzofuran (Exemplified Compound (7))

100 ml of methylene chloride was added to 27.6 g (0.20 mol) of 3-methyl-4-methoxyphenol, and then 12.7 g (0.10 mol) of 1.3-dichloro-2-propanone was dissolved therein, followed by stirring at 0° to 5° C. 6 ml of concentrated sulfuric acid were added dropwise over 1 hour, followed by stirring for 2 hours further. The reaction mixture was poured into 200 ml of ice water, and 100 ml of methylene chloride was added to effect extraction. The extract was washed twice with 200 ml of cold water, and then dried over calcium chloride. After the calcium chloride was filtered off, the methylene chloride was distilled off under reduced pressure and the unreacted raw materials were quickly removed from the resulting oil by column chromatography. The oil obtained was added to 70 ml of benzene followed by stirring at 10° to 15° C. Then 1.5 g (0.063 mol) of sodium hydride was gradually added. After stirring for 1 hour further, the mixture was cooled to 0° to 10° C. and 20 ml of methanol was added dropwise over 10 min while stirring. The reaction mixture was poured into 200 ml of ice water containing 5 ml of concentrated hydrochloric acid. Then 100 ml of ethyl acetate was added to effect extraction, and after the extract was washed twice with 200 ml of cold water it was dried over anhydrous sodium sulfate. After the anhydrous sodium sulfate was filtered off, the ethyl acetate was distilled off under reduced pressure, and the oil obtained was purified by column chromatography. Crystalization of the resultant from 20 ml of methanol was carred out, and recrystalization from 30 ml of methanol was effected to obtain 5.9 g of Exemplified Compound (7). Yield: 19%; m.p.: 79° to 80° C.

| Analysis | C | H |
|---|---|---|
| Found | 73.11% | 6.47% |
| Calculated for $C_{19}H_{20}O_4$ | 73.06% | 6.45% |

Synthesis of 5,5,5',6'-dimethylenedioxy-3,3'(2H,2'H)-spirobenzofuran (Exemplified Compound (10))

100 ml of methylene chloride was added to 13.8 g (0.10 mol) of 3,4-methylenedioxyphenol, and then 6.35 g (0.05 mol) of 1,3-dichloro-2-propanone was added, followed by stirring at 5° to 10° C. Then 3 ml of concentrated sulfuric acid was added dropwise over 15 min, and thereafter stirring for 4 hours resulted in crystalization. The resulted crystals were filtered and washed with 50 ml of methylene chloride. The crystals were dissolved in 100 ml of DMAc and the solution was stirred at 0° to 5° C. Then, 2.4 g (0.10 mol) of sodium hydride was added gradually to the solution. After stirring the mixture for a 1 hour further, 20 ml of methanol was added dropwise over 10 min. Then reaction mixture was poured into 200 mol of ice water containing 5 ml of concentrated hydrochloric acid. 300 ml of ethyl acetate was added to effect extraction, and after the extract was washed twice with 200 ml of cold water, it was dried over anhydrous sodium sulfate. After the anhydrous sodium sulfate was filtered off, the ethyl acetate was distilled off to deposit crystals. 50 ml of methanol were added to crystals, followed by filtering, and recrystalization from 100 ml of ethyl acetate was carried out to obtain 9.8 g of Exemplified Compound (10). Yield: 63%; m.p.: 211° to 213° C.

| Analysis | H | C |
|---|---|---|
| Found | 65.42% | 3.88% |
| Calculated for $C_{17}H_{12}O_6$ | 65.39% | 3.87% |

The compounds represented by general formula (I) according to the present invention can be used in combination with a yellow coupler, a magenta coupler or a cyan coupler.

The couplers that can be used in combination with the compounds represented by general formula (I) may be 4-equivalent or 2-equivalent to a silver ion and may be a polymer or an oligomer. These couplers can be used alone, or two or more such couplers can be combined.

The general formulas of preferable couplers that can be used in the present invention are given below.

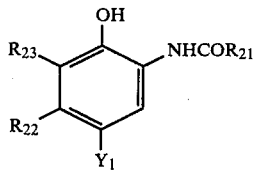

General formula (II)

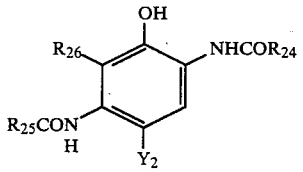

General formula (III)

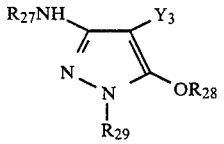

General formula (IV)

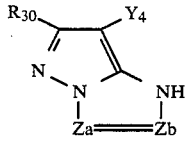

General formula (V)

-continued

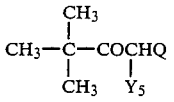

General formula (VI)

wherein $R_{21}$, $R_{24}$ and $R_{25}$ each represent an aliphatic group, aromatic group, heterocyclic group, aromatic amino group, or heterocyclic amino group; $R_{22}$ represents an aliphatic group; $R_{23}$ and $R_{26}$ each represent a hydrogen atom, halogen atom, aliphatic group, aliphatic oxy group or acylamino group; $R_{27}$ and $R_{29}$ each represent a substituted or unsubstituted phenyl group; $R_{28}$ represents a hydrogen atom, aliphatic or aromatic acyl group, or aliphatic or aromatic sulfonyl group; $R_{30}$ represents a hydrogen atom or a substituent; Q represents a substituted or unsubstituted N-phenylcarbamoyl group; Za and Zb each represent a methine group, substituted methine group or =N—; and $Y_1$, $Y_2$, $Y_3$, $Y_4$ and $Y_5$ each represent a group capable of splitting off at the time of coupling reaction with the oxidation product of a developing agent (hereinafter referred to as a coupling split-off group).

In general formulas (II) and (III), $R_{22}$ and $R_{23}$, and $R_{25}$ and $R_{26}$ respectively may form a 5, 6 or 7-membered ring.

Further, dimers or more higher polymers may be formed through $R_{21}$, $R_{22}$, $R_{23}$ or $Y_1$; $R_{24}$, $R_{25}$, $R_{26}$ or $Y_2$; $R_{27}$, $R_{28}$, $R_{29}$ or $Y_3$; $R_{30}$, Za, Zb or $Y_4$; Q or $Y_5$.

The aliphatic groups mentioned above represent linear, branched or cyclic alkyl, alkenyl or alkynyl groups.

Preferable examples of the couplers represented by general formulas (II) and (III) are enumerated below.

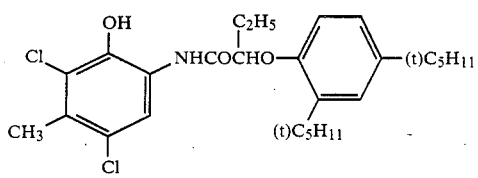

(C-1)

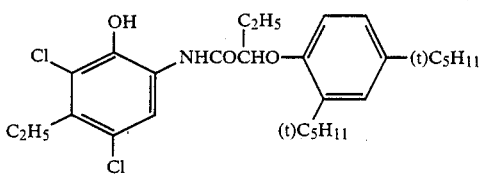

(C-2)

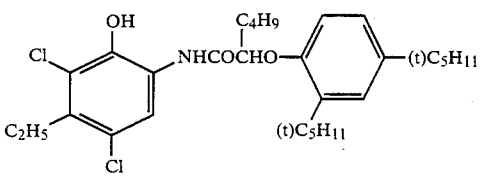

(C-3)

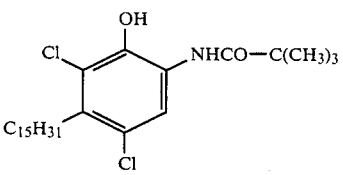

(C-4)

-continued
(C-5)
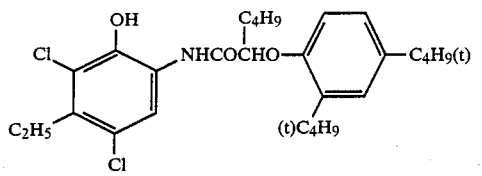
(C-6)
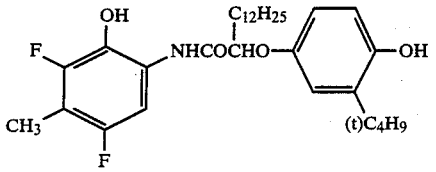
(C-7)
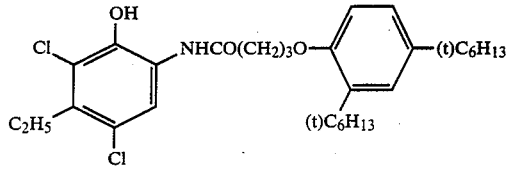
(C-8)
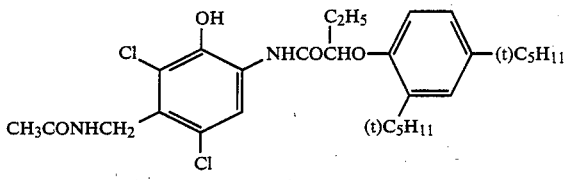
(C-9)
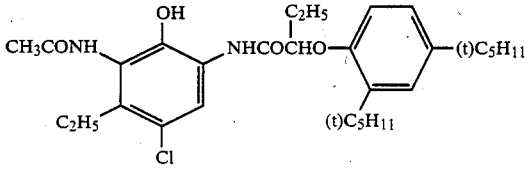
(C-10)
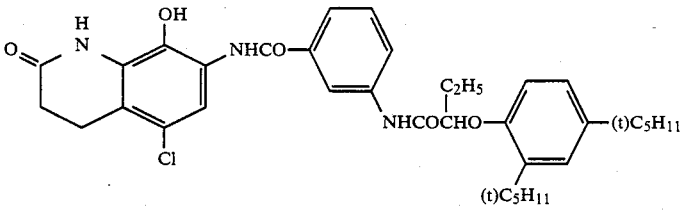
(C-11)
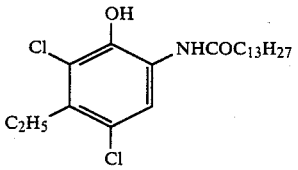
(C-12)
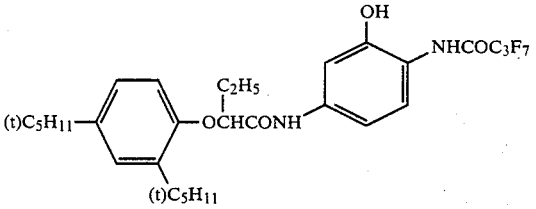

-continued
(C-13)
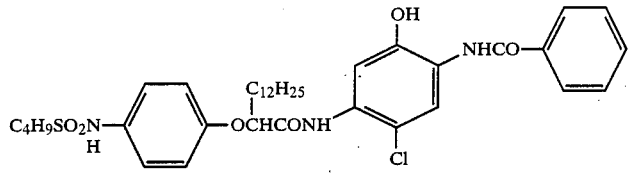
(C-14)
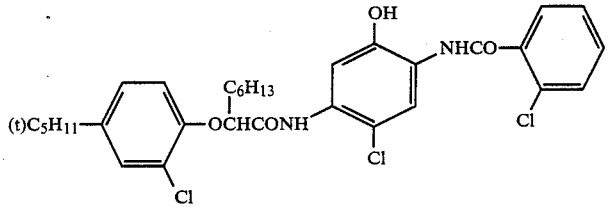
(C-15)
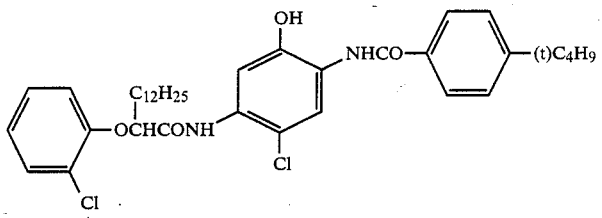
(C-16)
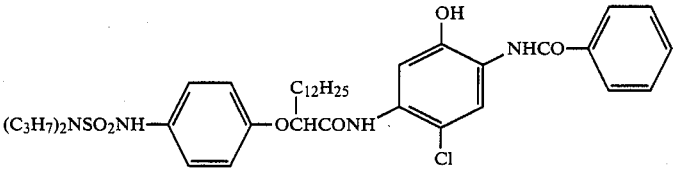
(C-17)
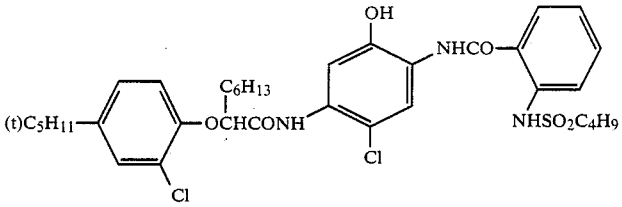
(C-18)
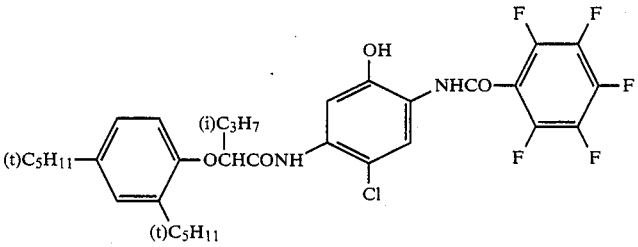
(C-19)
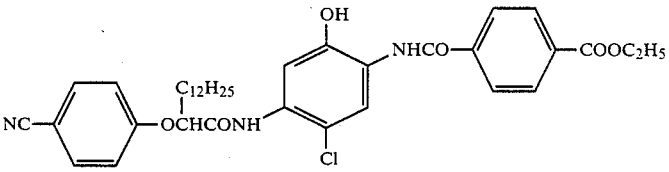

-continued
(C-20)
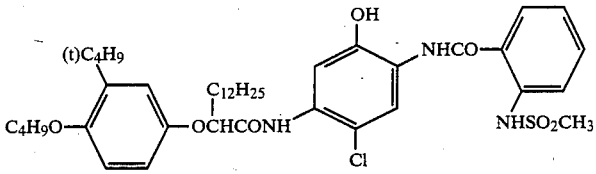
(C-21)
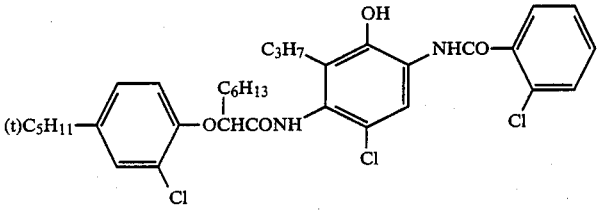
(C-22)
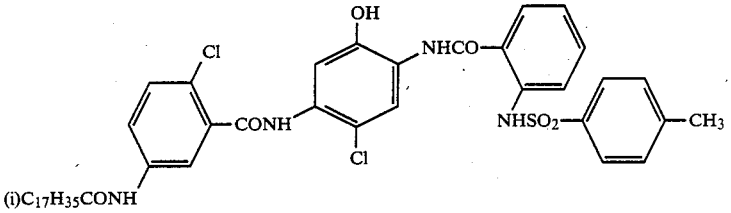
(C-23)
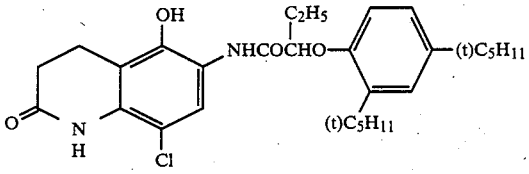
(C-24)
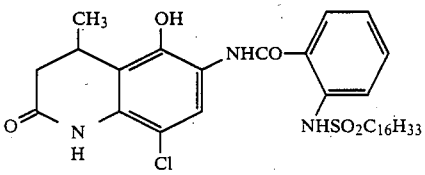
(C-25)
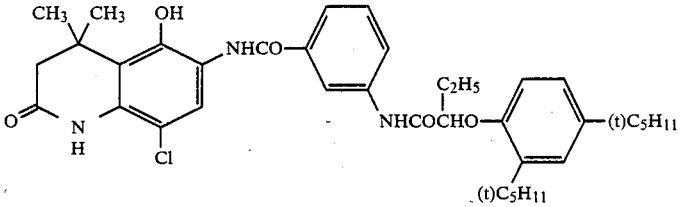
(C-26)
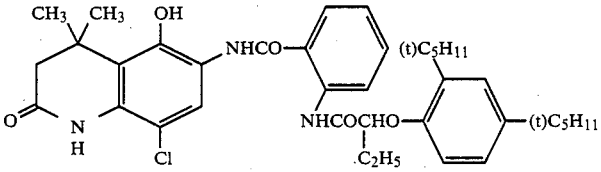
(C-27)
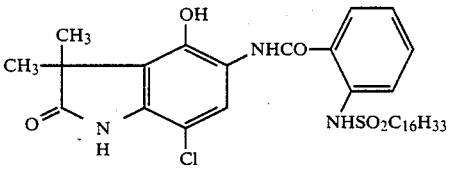

-continued
(C-28)
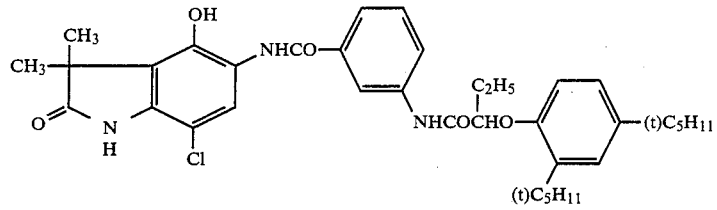
(C-29)
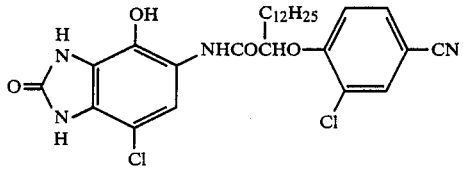
(C-30)
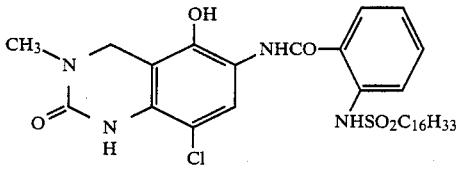
(C-31)
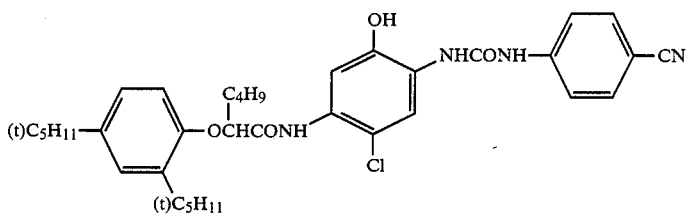
(C-32)
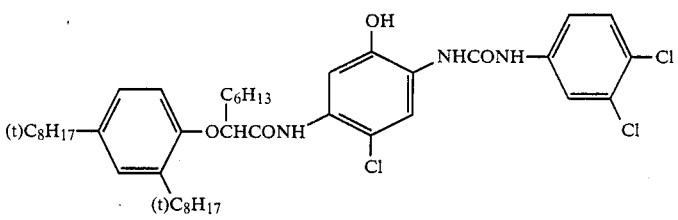
(C-33)
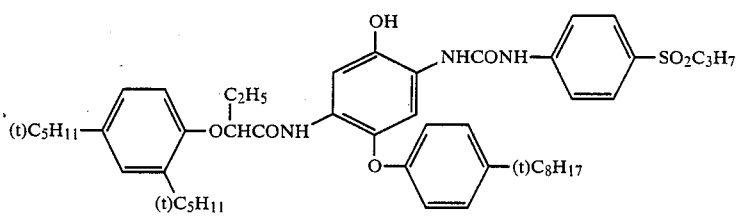
(C-34)
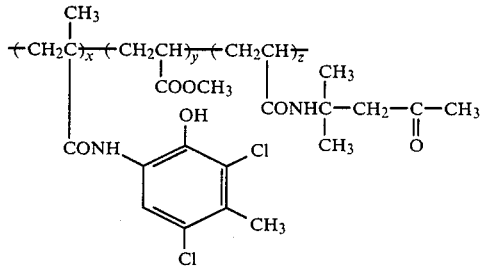
x/y/z = 50/20/30 (weight ratio)

-continued
(C-35)
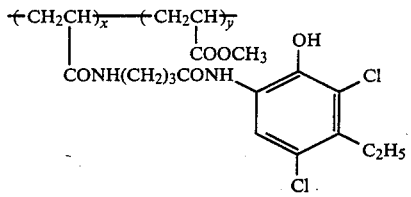
x/y = 55/45 (weight ratio)
(C-36)
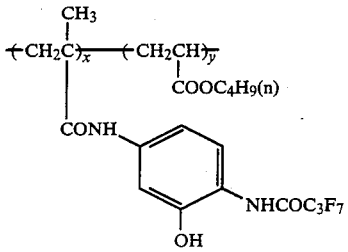
x/y = 60/40 (weight ratio)
(C-37)
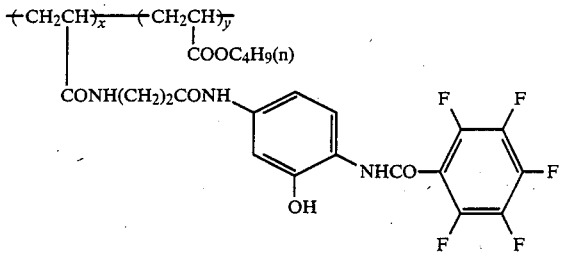
x/y = 50/50 (weight ratio)
(C-38)
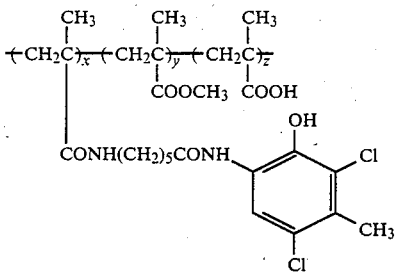
x/y/z = 55/40/5 (weight ratio)
(C-39)
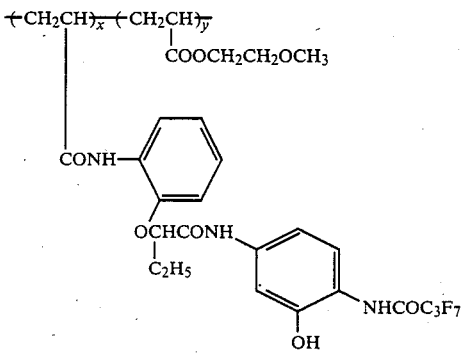
x/y = 60/40 (weight ratio)

-continued
(C-40)
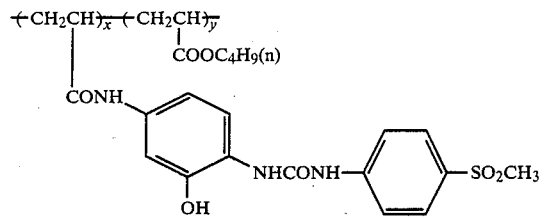
x/y = 50/50 (weight ratio)
(C-41)
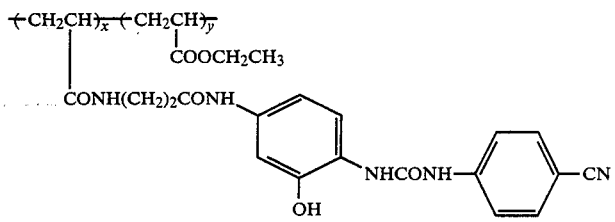
x/y = 45/55 (weight ratio)
(C-42)
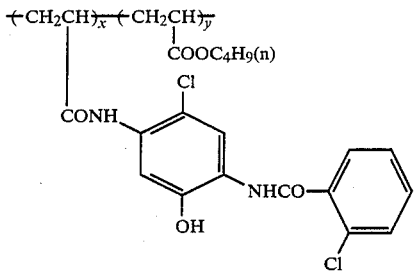
x/y = 50/50 (weight ratio)
(C-43)
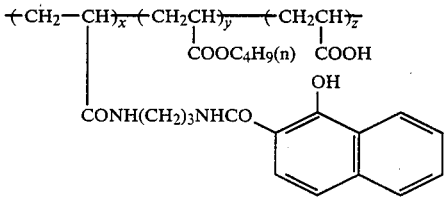
x/y/z = 45/45/10 (weight ratio)
(C-44)
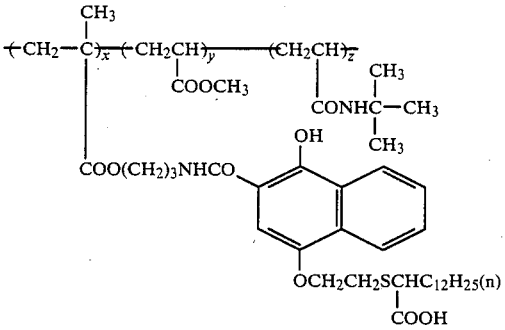
x/y/z = 50/20/30 (weight ratio)
(C-45)
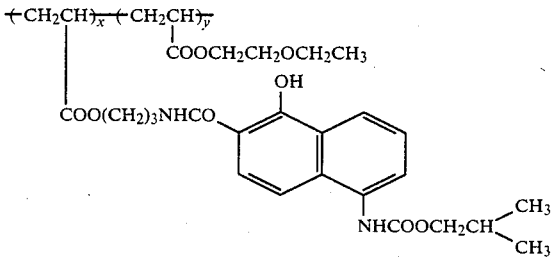
x/y = 50/50 (weight ratio)

-continued
(C-46)
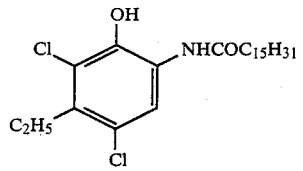
(C-47)
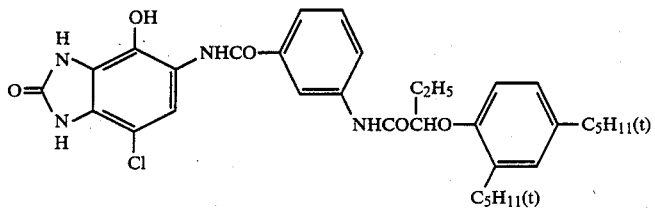
(C-48)
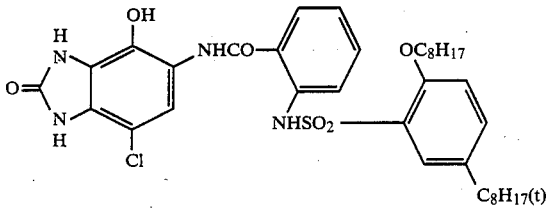
(C-49)
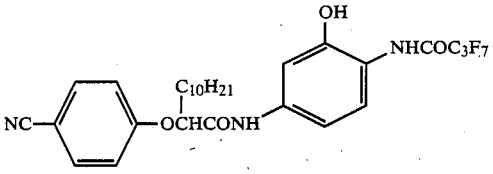
Preferable examples of the couplers represented by general formulas (IV) and (V) are enumerated below.
(M-1)
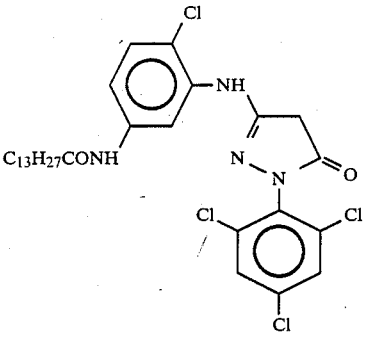
(M-2)
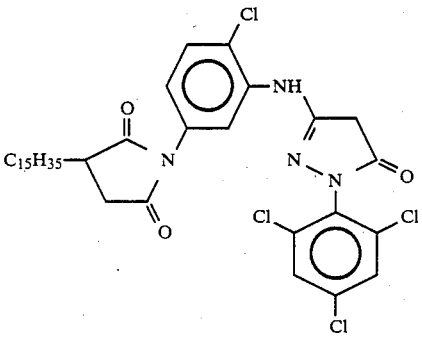

-continued
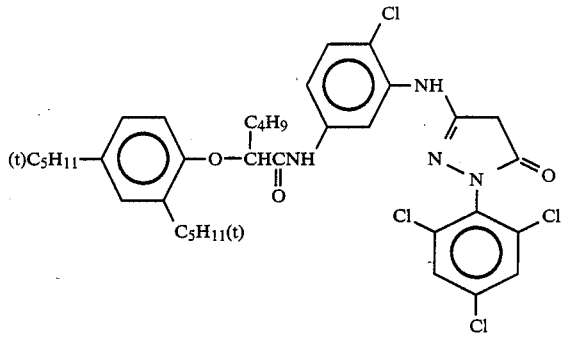
(M-3)
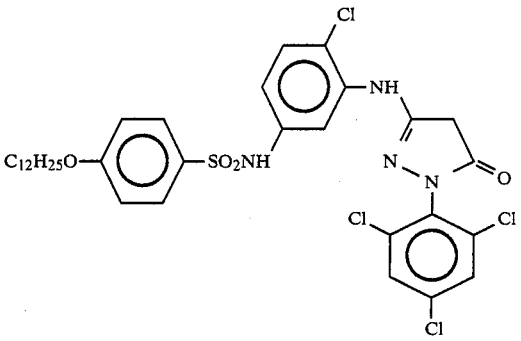
(M-4)
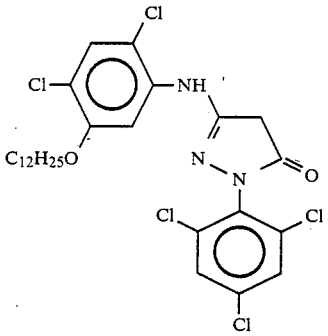
(M-5)
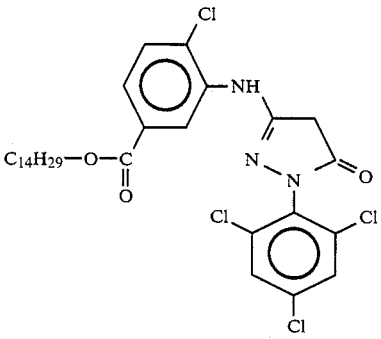
(M-6)

-continued
(M-7)
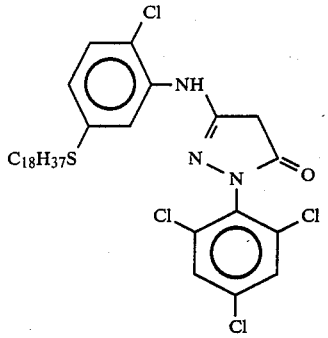
(M-8)
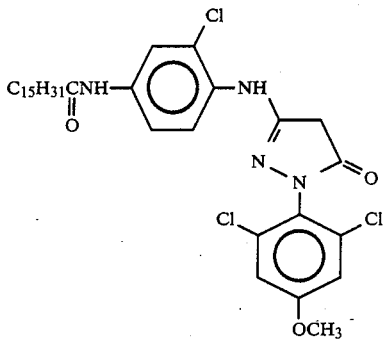
(M-9)
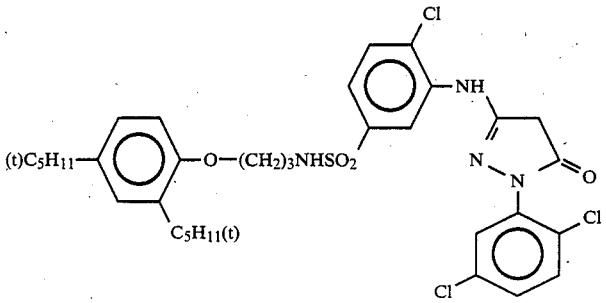
(M-10)
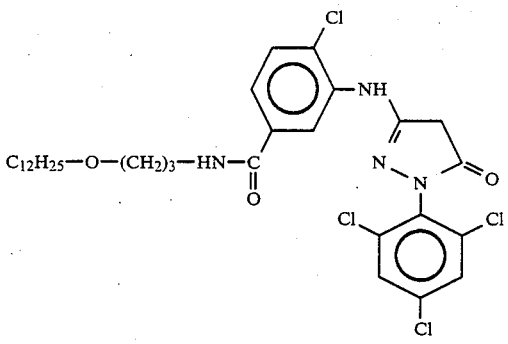
(M-11)
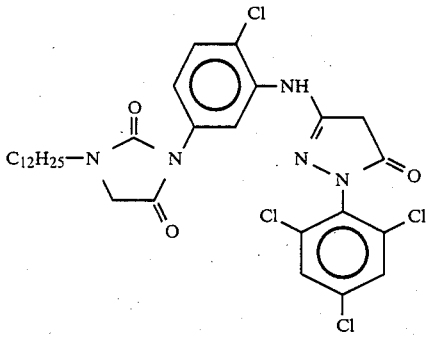

-continued
(M-12)
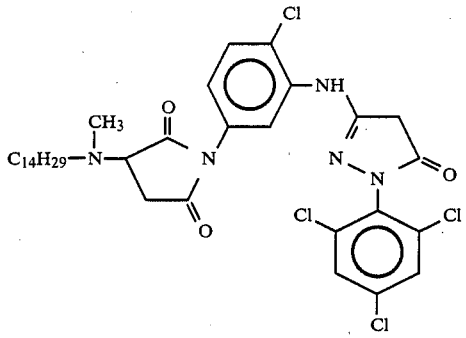
(M-13)
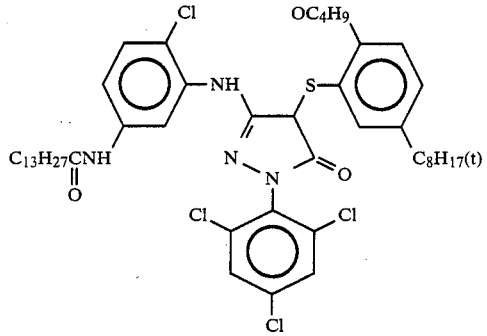
(M-14)
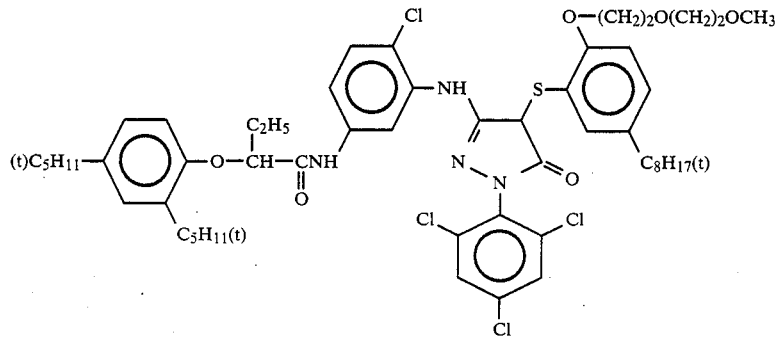
(M-15)
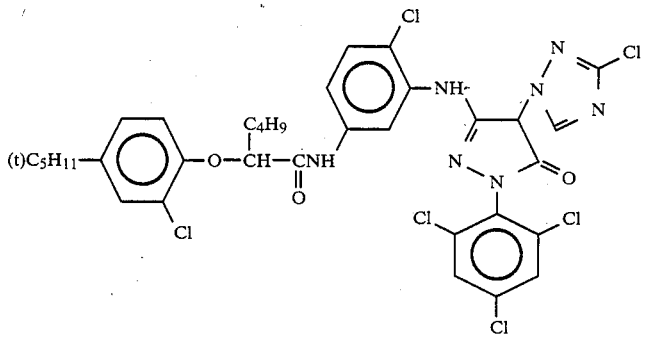
(M-16)
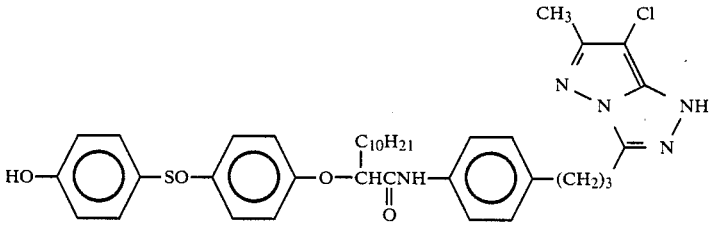

-continued
(M-17)
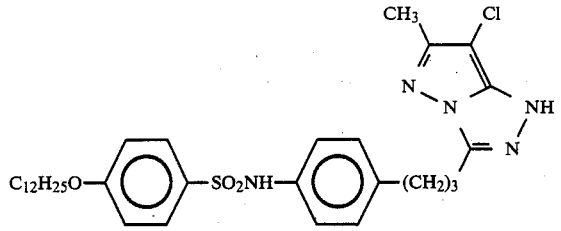
(M-18)
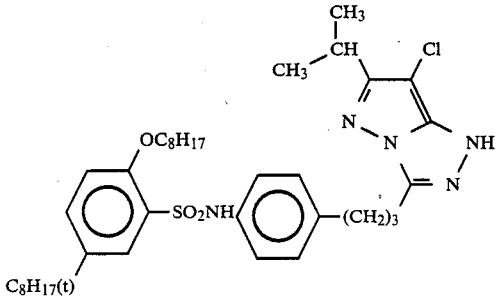
(M-19)
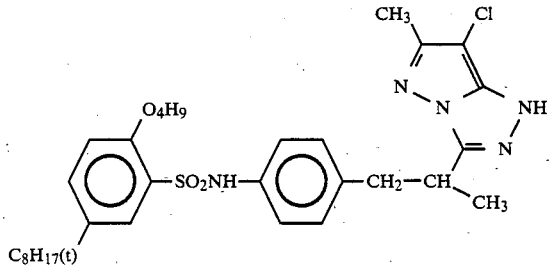
(M-20)
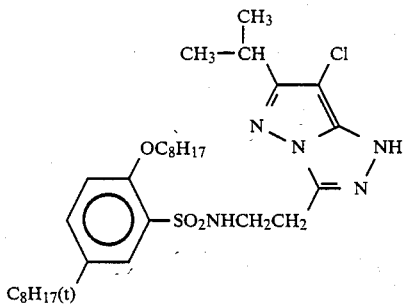
(M-21)
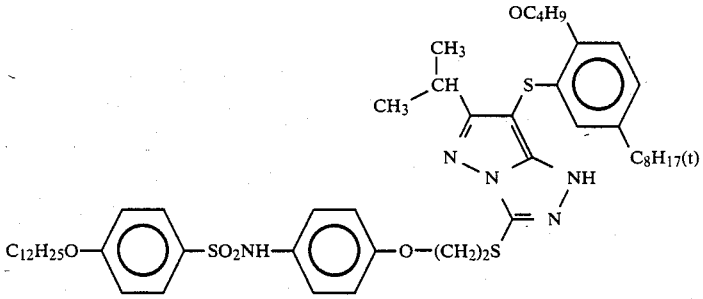

-continued
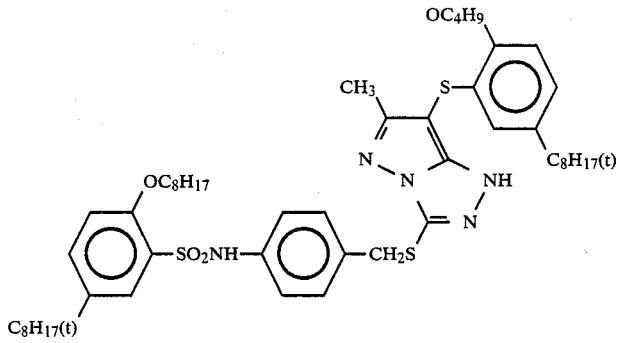
(M-22)
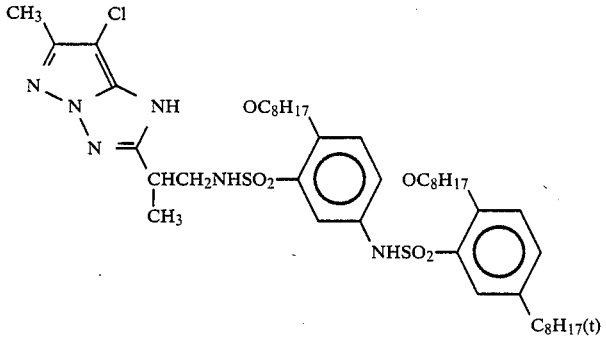
(M-23)
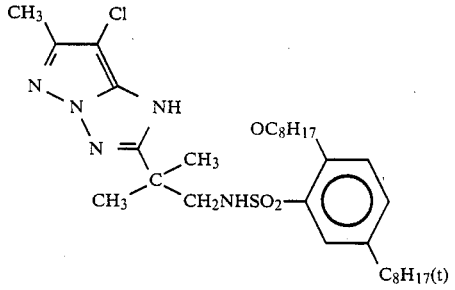
(M-24)
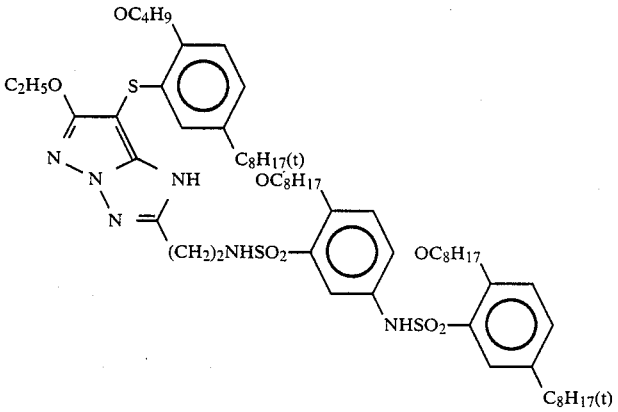
(M-25)

-continued
(M-26)
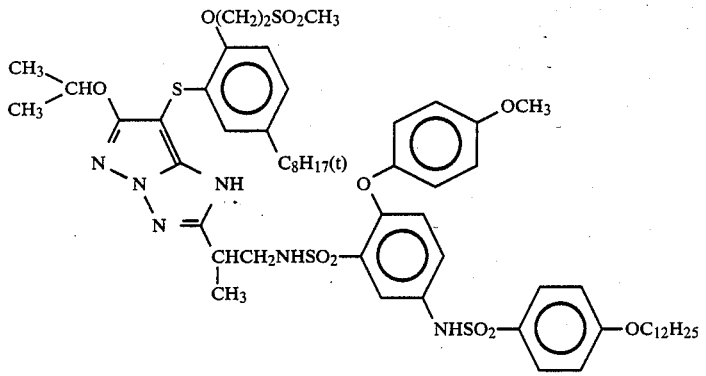
(M-27)
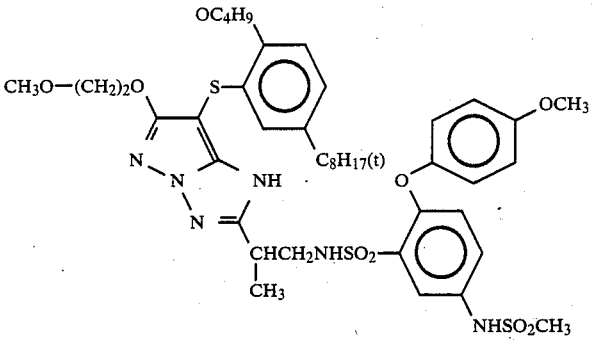
(M-28)
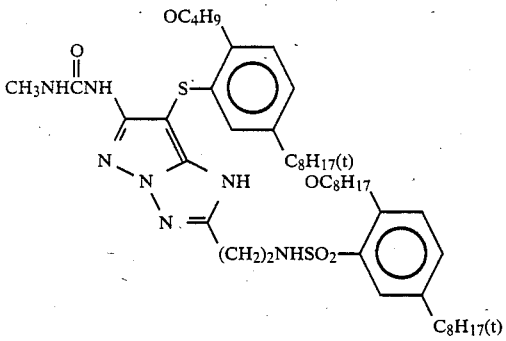
(M-29)
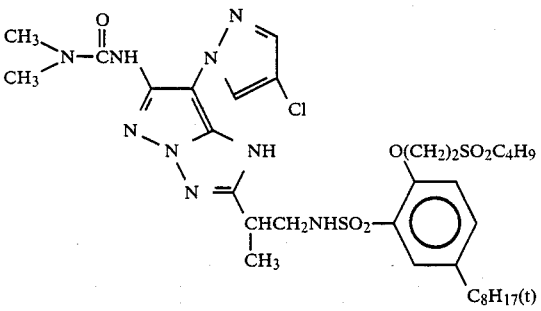

-continued
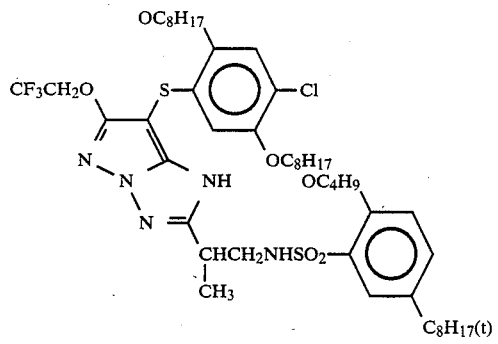
(M-30)
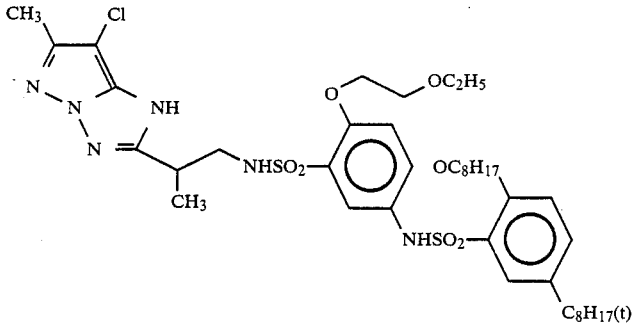
(M-31)
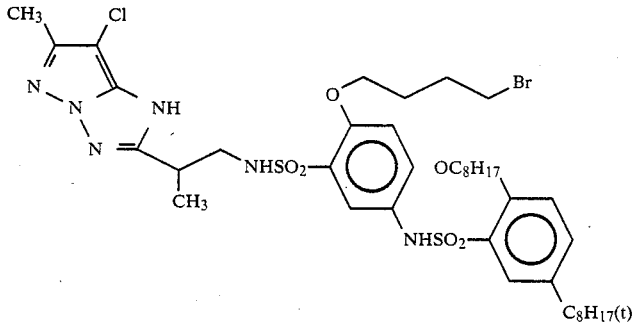
(M-32)
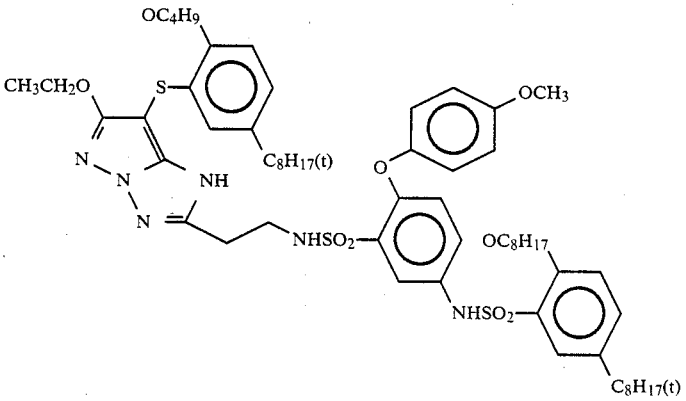
(M-33)

-continued
(M-34)
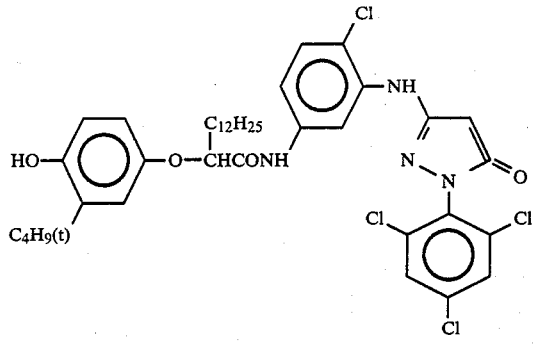
(M-35)
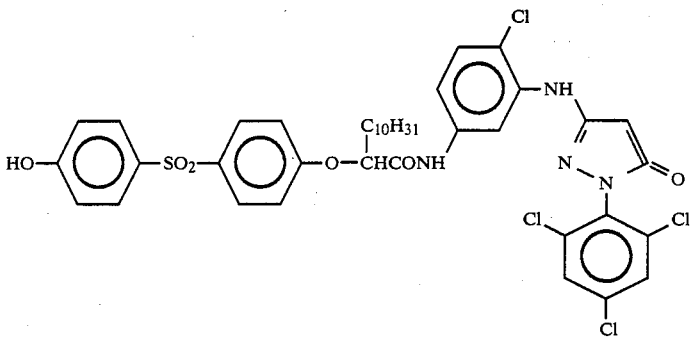
(M-36)
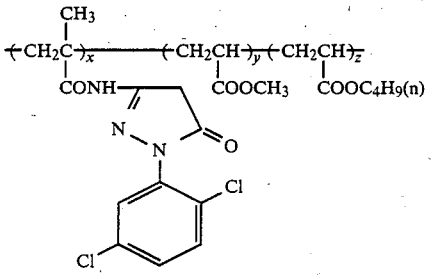
x/y/z = 50/25/25
(weight ratio)
(M-37)
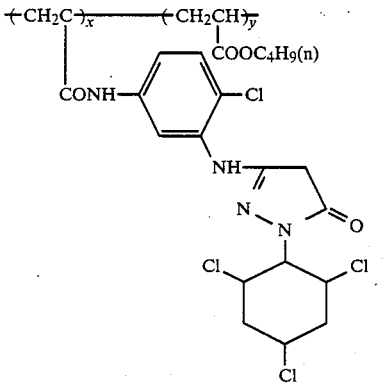
x/y = 50/50
(weight ratio)

-continued
(M-38)
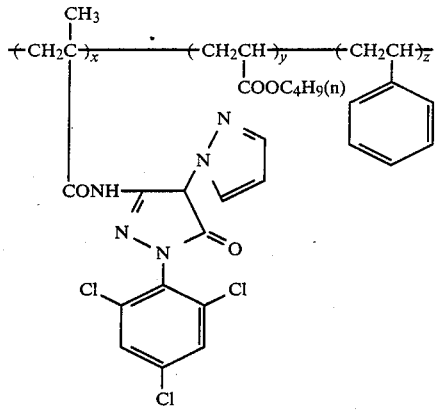
x/y/z = 50/25/25
(weight ratio)
(M-39)
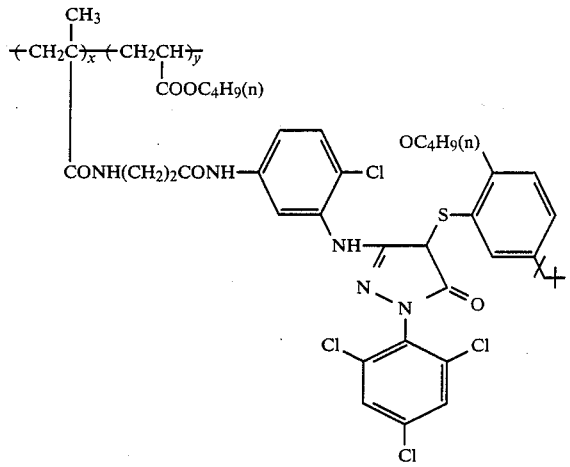
x/y = 50/50
(weight ratio)
(M-40)
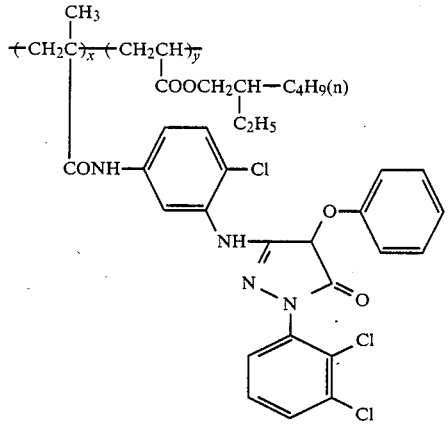
x/y = 40/60
(weight ratio)
(M-41)
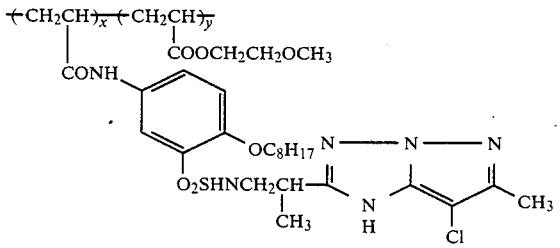

-continued
x/y = 45/55
(weight ratio)
(M-42)
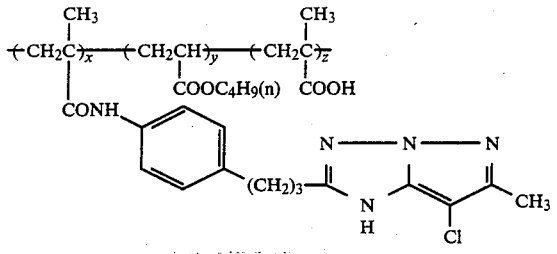
x/y/z = 50/45/5
(weight ratio)
(M-43)
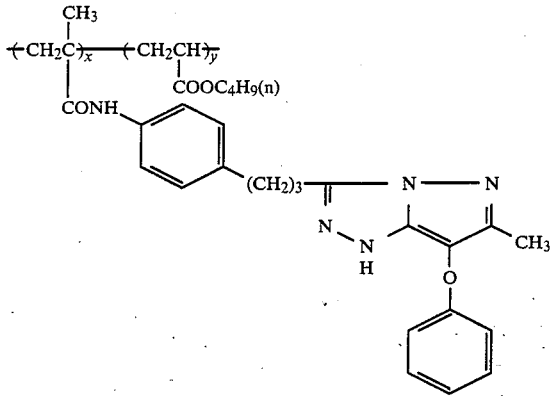
x/y = 50/50
(weight ratio)
(M-44)
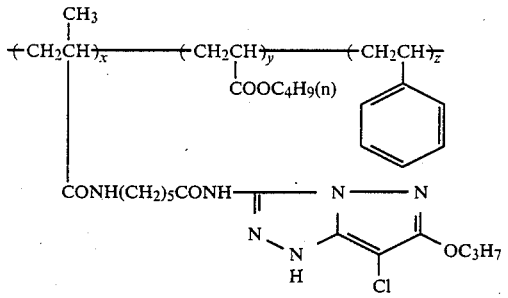
x/y/z = 45/50/5
(weight ratio)
(M-45)
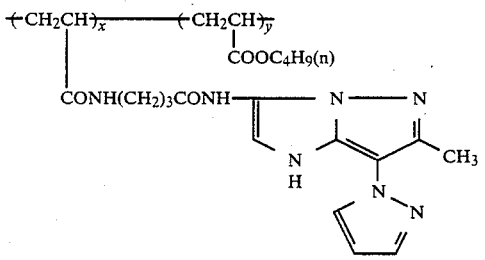
x/y = 50/50
(weight ratio)

-continued
(M-46)
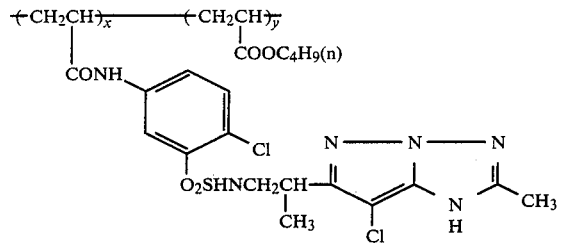
x/y = 50/50
(weight ratio)
(M-47)
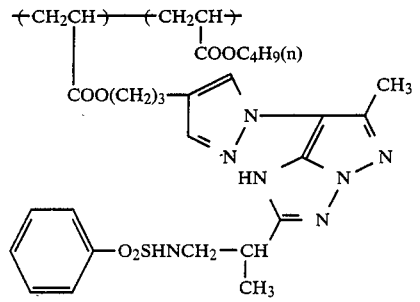
x/y = 45/55
(weight ratio)
(M-48)
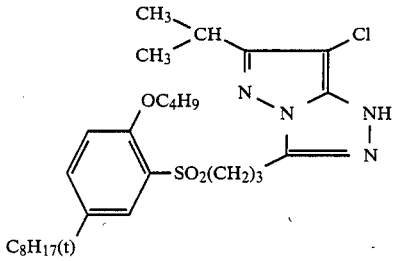
(M-49)
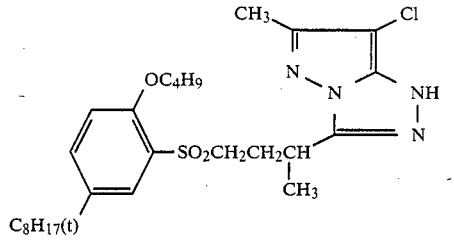
(M-50)
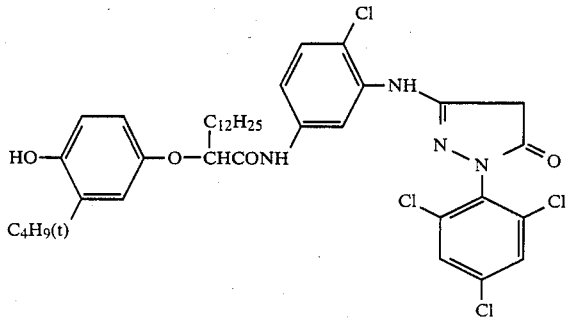
Preferable examples of the couplers represented by general formula (VI) are enumerated below.

(Y-1)
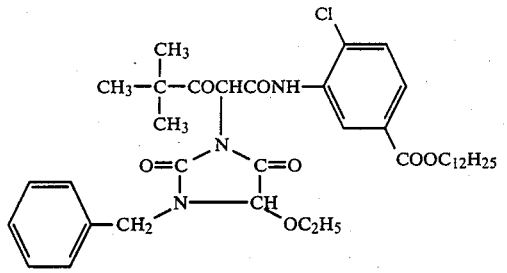
(Y-2)
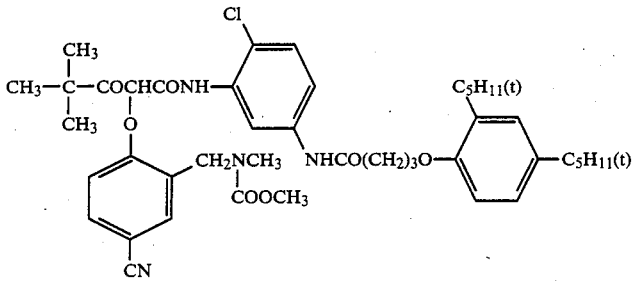
(Y-3)
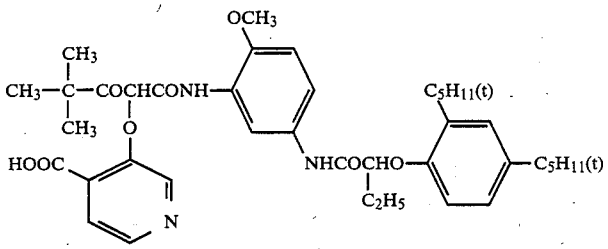
(Y-4)
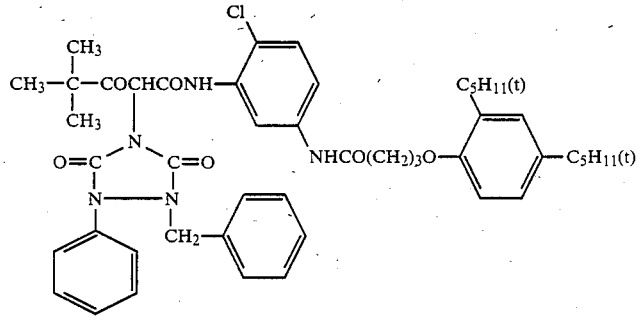
(Y-5)
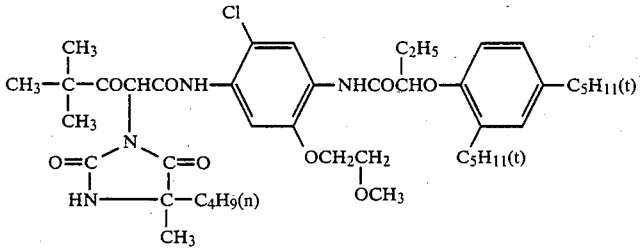
(Y-6)
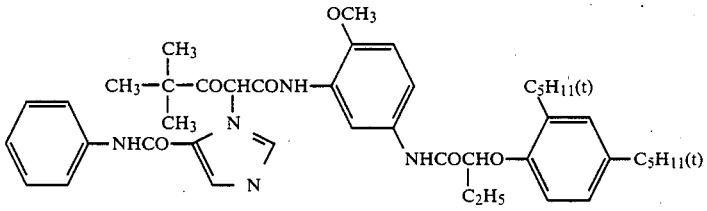

-continued
(Y-7)
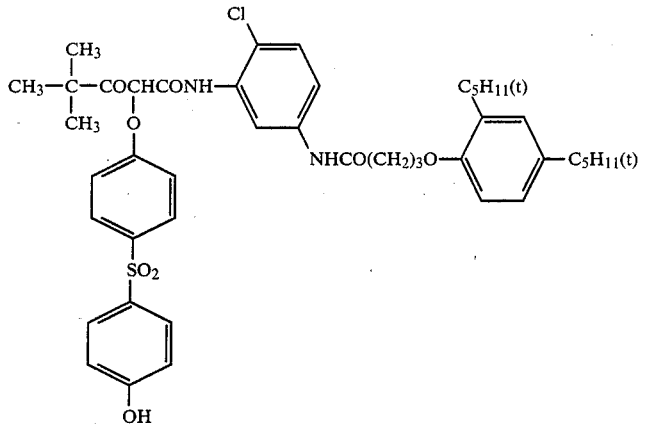
(Y-8)
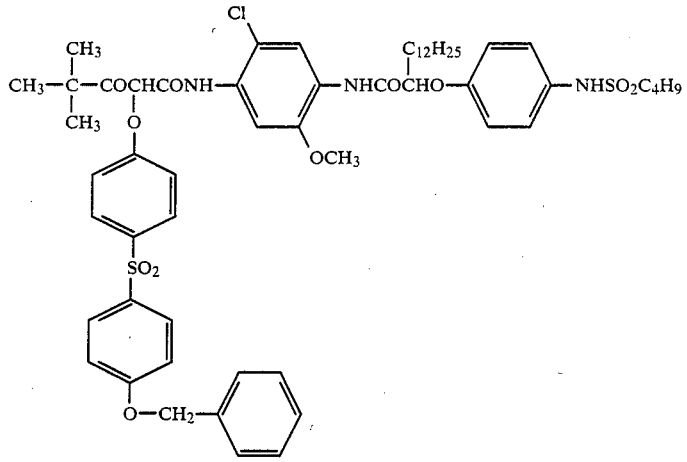
(Y-9)
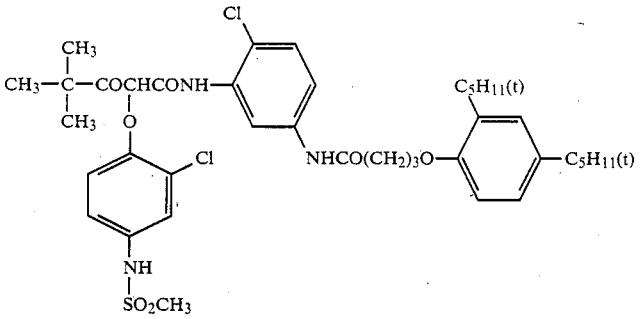
(Y-10)
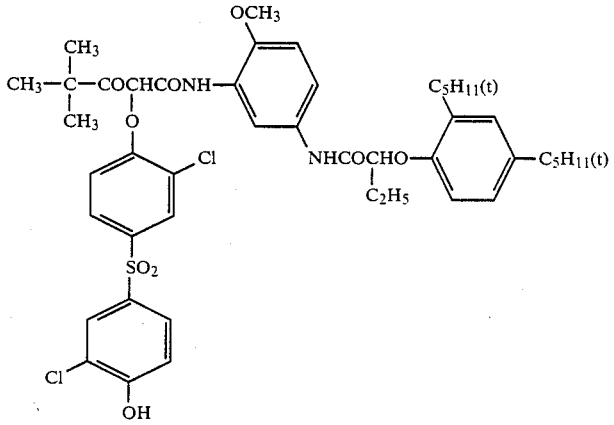

-continued
(Y-11)
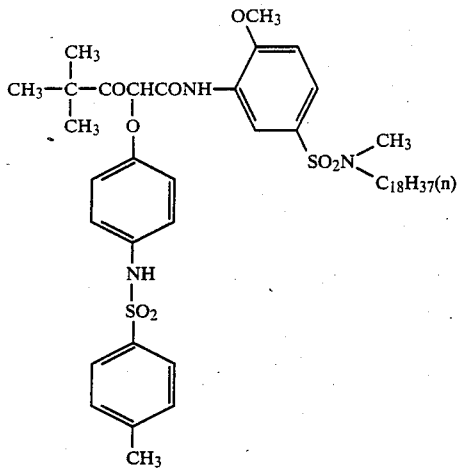
(Y-12)
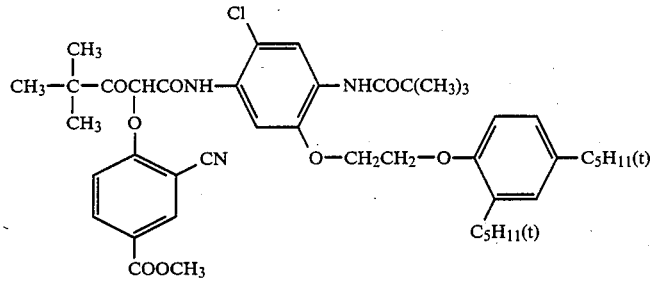
(Y-13)
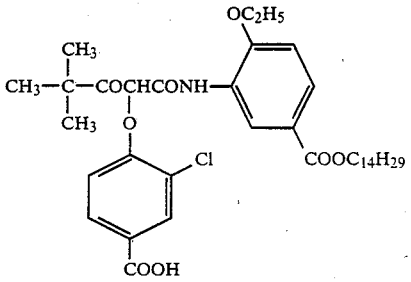
(Y-14)
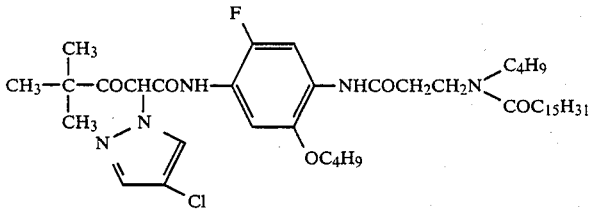
(Y-15)
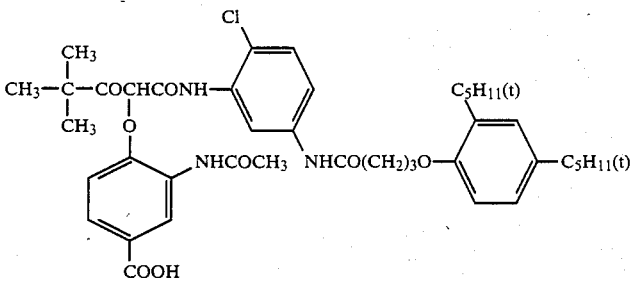

-continued
(Y-16)
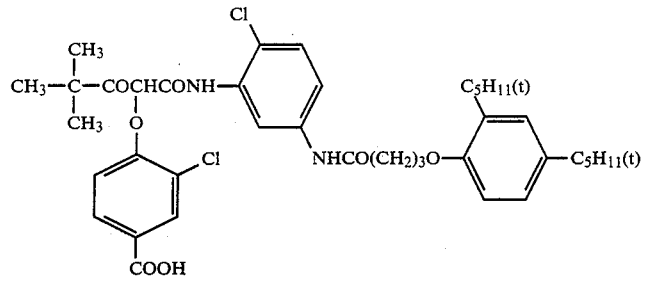
(Y-17)
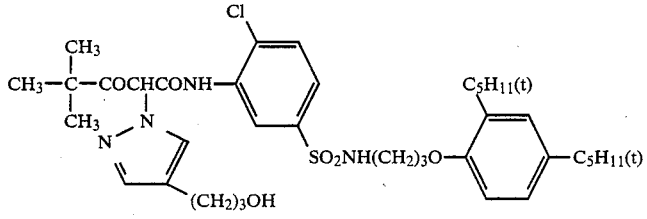
(Y-18)
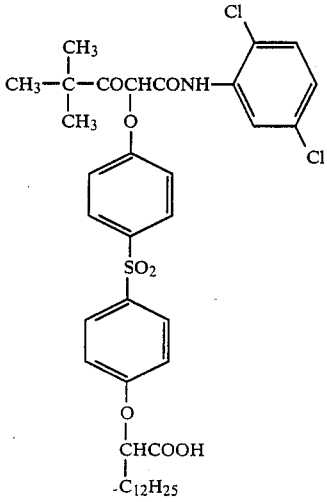
(Y-19)
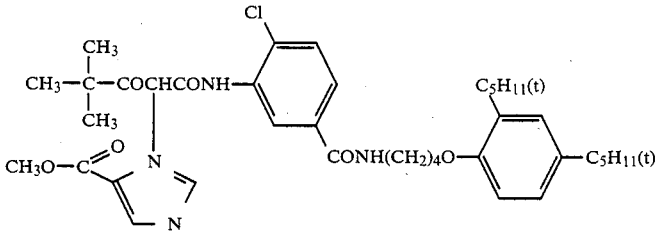
(Y-20)
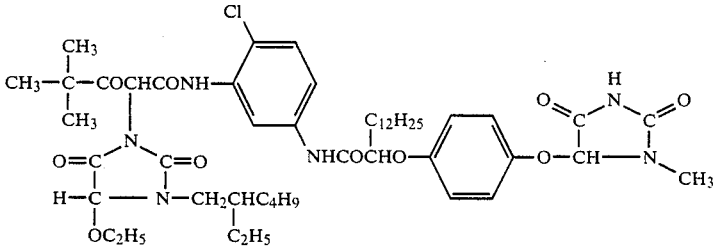

-continued
(Y-21)
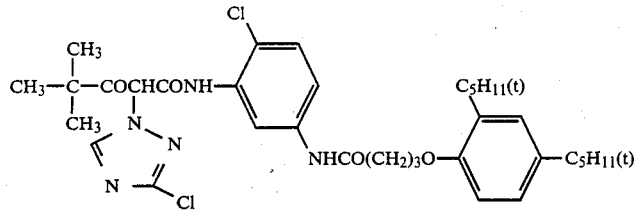
(Y-22)
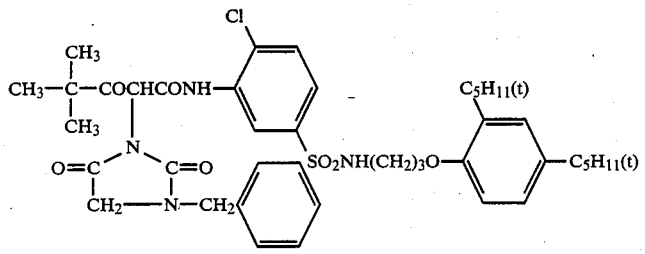
(Y-23)
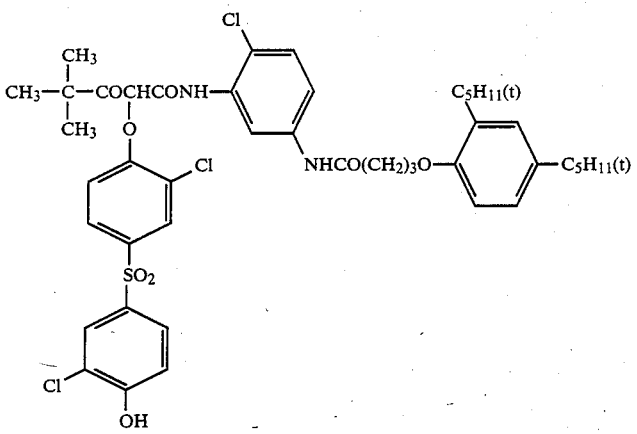
(Y-24)
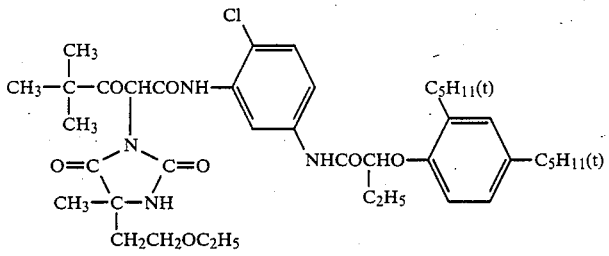
(Y-25)
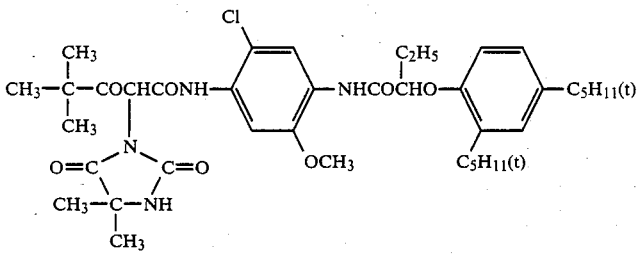
(Y-26)
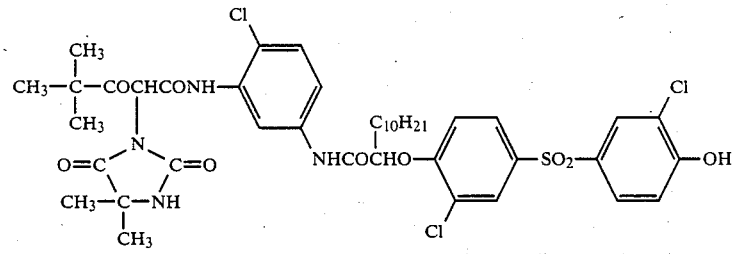

-continued
(Y-27)
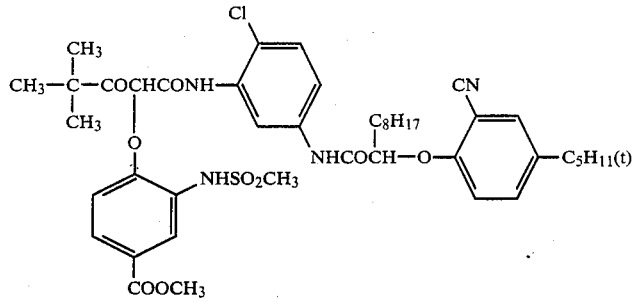
(Y-28)
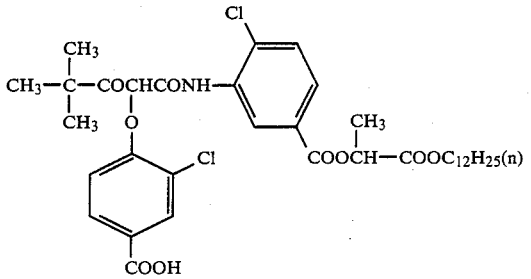
(Y-29)
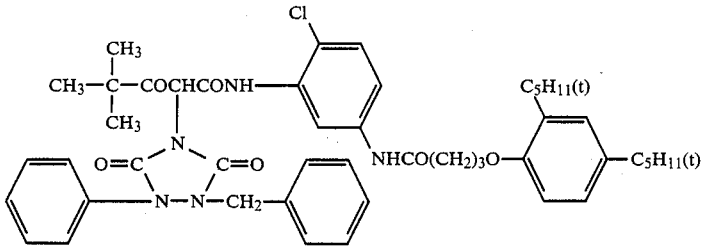
(Y-30)
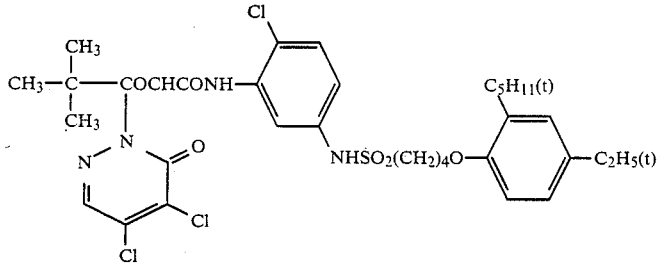
(Y-31)
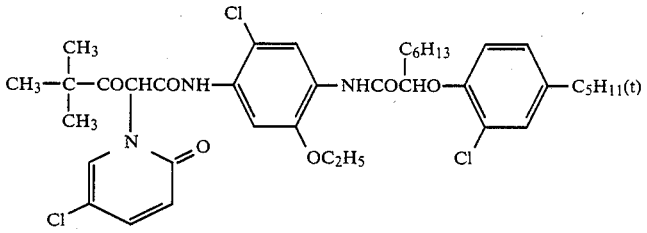
(Y-32)
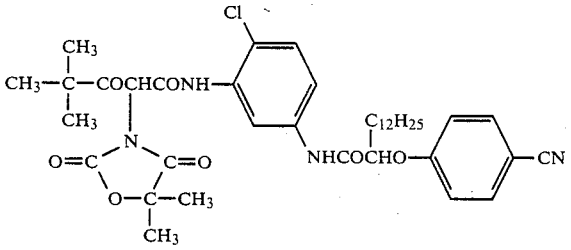

-continued
(Y-33)
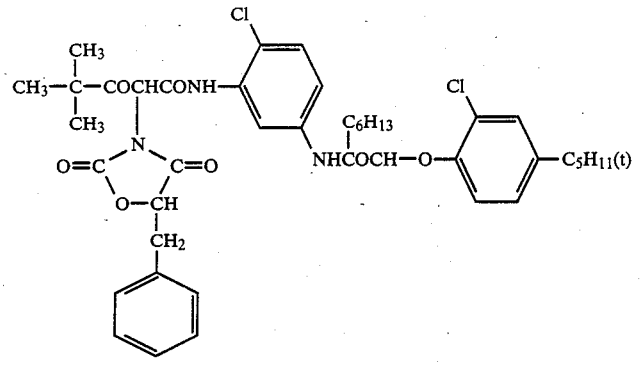
(Y-34)
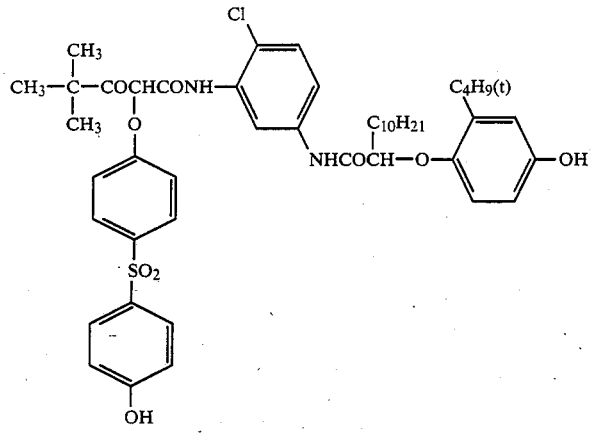
(Y-35)
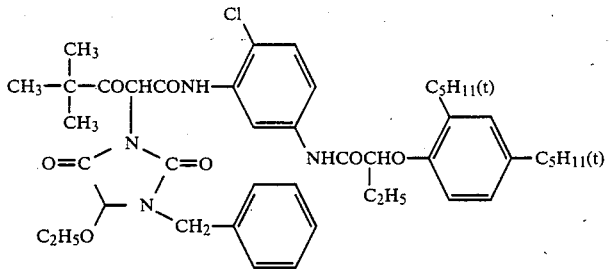
(Y-36)
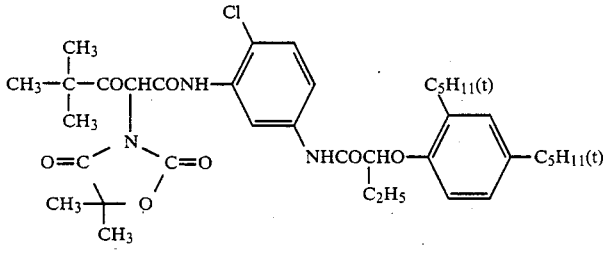

-continued
(Y-37)
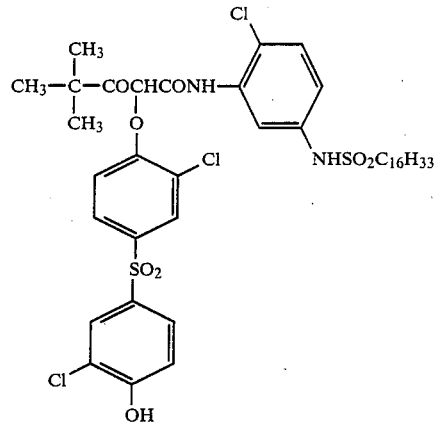
(Y-38)
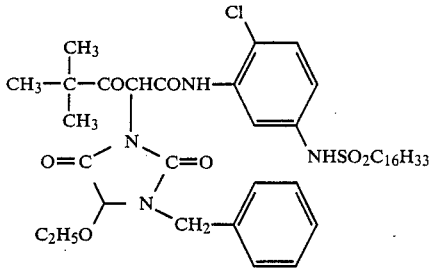
(Y-39)
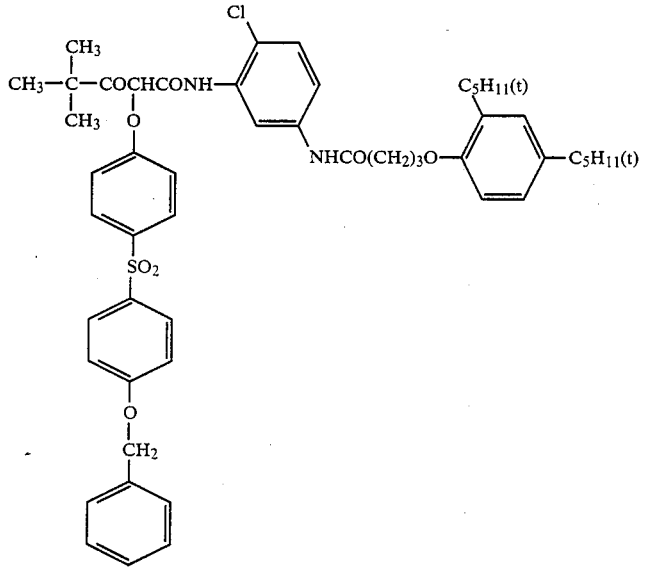
(Y-40)
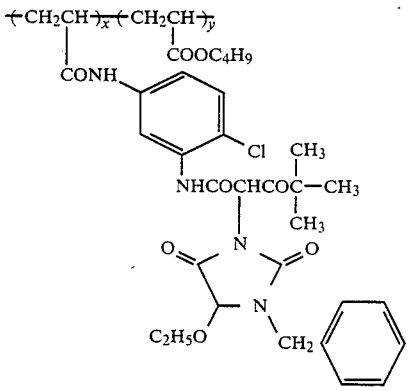

-continued-
x/y = 50/50 (weight ratio)
(Y-41)
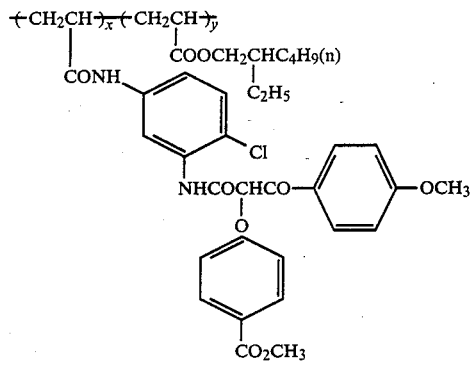
x/y = 45/55 (weight ratio)
(Y-42)
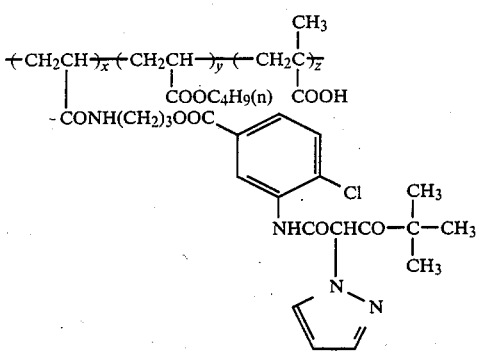
x/y/z = 50/45/5 (weight ratio)
(Y-43)
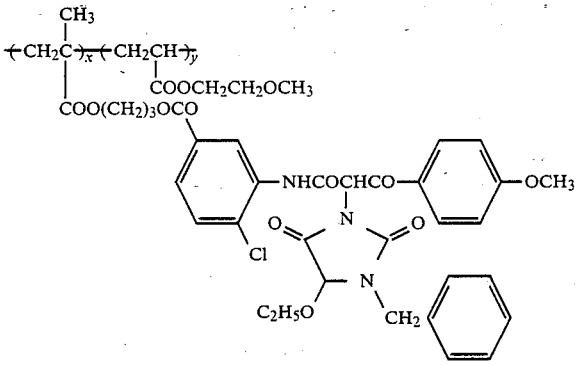
x/y = 50/50 (weight ratio)
(Y-44)
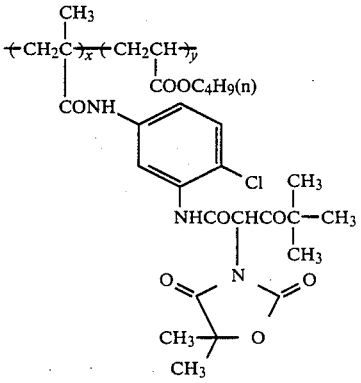

-continued
x/y = 50/50 (weight ratio)
(Y-45)
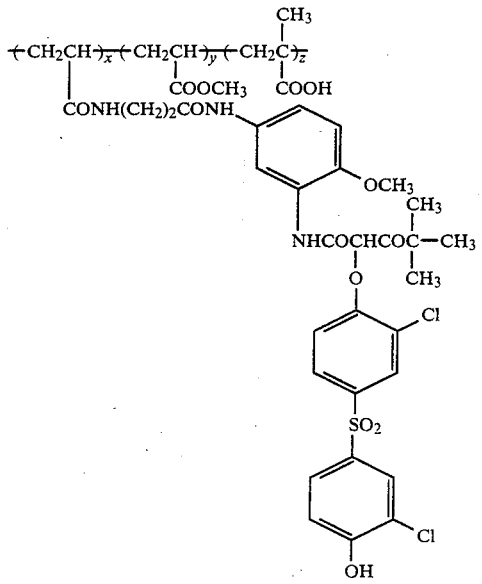
x/y/z = 55/40/5 (weight ratio)
(Y-46)
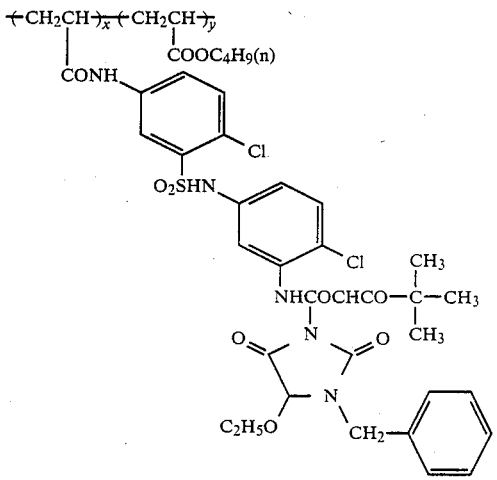
x/y = 60/40 (weight ratio)
(Y-47)
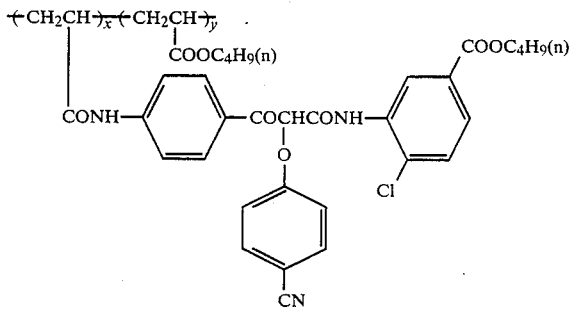
x/y = 50/50 (weight ratio)

-continued (Y-48)

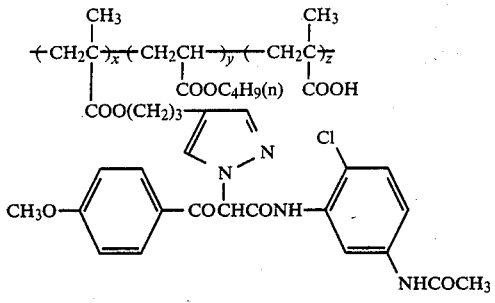

x/y/z = 60/30/10 (weight ratio)

(Y-49)

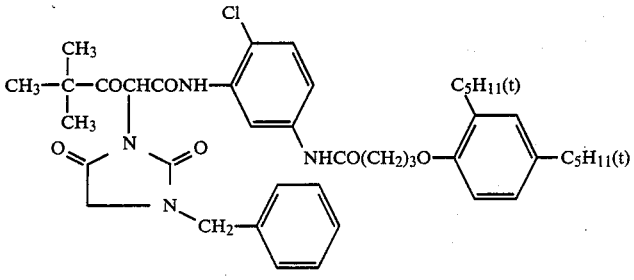

Publications in which other examples of couplers represented by general formula (II) through (VI) or synthesis methods therefor are described or mentioned below.

Cyan couplers represented by general formula (II) and (III) can be synthesized in a known manner. For example, cyan couplers represented by general formula (II) can be synthesized by the methods described in U.S. Pat. Nos. 2,423,730 and 3,772,002. Cyan couplers represented by general formula (III) can be synthesized by the methods described for example in U.S. Pat. Nos. 2,895,826, 4,333,999, and 4,327,173.

Magenta couplers represented by general formula (IV) can be synthesized by the methods described for example in Japanese patent application (OPI) Nos. 74027/1974 and 74028/1974, Japanese Patent Publication Nos. 27930/1973 and 33846/1978, U.S. Pat. No. 3,519,429. Magenta couplers represented by general formula (V) can be synthesized by the methods described for example in Japanese patent application (OPI) No. 162548/1984, U.S. Pat. No. 3,725,067, Japanese patent application (OPI) Nos. 171,956/1984 and 33,552/1985.

Yellow couplers represented by general formula (VI) can be synthesized by the methods described for example in Japanese patent application (OPI) No. 48541/1979, Japanese Patent Publication No. 10739/1983, U.S. Pat. No. 4,326,024, Research Disclosure 18053.

Couplers used in the present invention may include colored couplers having an effect for correcting color, and couplers that release a development restrainer with the development (the so-called DIR couplers). The couplers may be those which form by the coupling reaction of colorless products.

Colored couplers which can be used, include for example, those described in U.S. Pat. Nos. 3,476,560, 2,521,908 and 3,034,892, Japanese Patent Publication Nos. 2016/1969, 22335/1963, 11304/1967 and 32461/1969, Japanese patent application (OPI) Nos. 26034/1976 and 42121/1977, and West Germany patent application (OLS) No. 2,418,959.

DIR couplers which can be used, include for example, those described in U.S. Pat. Nos. 3,227,554, 3,617,291, 3,701,783, 3,790,384 and 3,632,345, West Germany patent application (OLS) Nos. 2,414,006, 2,454,301 and 2,454,329, British Pat. No. 953,454, Japanese patent application (OPI) Nos. 69624/1977 and 122335/1974 and Japanese Patent Publication No. 16141/1976.

In addition to DIR couplers, a compound that a development restrainer with the development can be contained in the photosensitive material, and for example those described in U.S. Pat. Nos. 3,297,445, and 3,379,529, West Germany patent application (OLS) No. 2,417,914, and Japanese patent application (OPI) Nos. 15271/1977 and 9116/1978 can be used.

In the present invention, these are particularly effective when combined with the magenta couplers represented by general formula (IV) or (V).

These couplers are generally added in an amount of $2\times10^{-3}$ to $5\times10^{-1}$ mol, preferably $1\times10^{-2}$ to $5\times10^{-1}$ mol, per mol of silver in the emulsion.

Preferably used as a silver halide ingredient or a silver halide grain composition according to the present invention is silver chlorobromide or silver bromochloroiodide. A mixture of silver chloride and silver bromide or the like may be used. In the present invention, if the silver halide emulsion is used for color photographic paper, since a particularly high developing speed and excellent processability are required, it is preferable that the halogen composition of the silver halide contains chlorine atoms, and the composition comprises preferably silver bromochloride or silver bromochloroiodide containing at least 1 mol % of silver chloride. Particularly preferably the content of silver chloride is 10 mol % or over. If the silver halide used in the present invention is silver bromochloroiodide, it is preferable that the content of silver iodide is up to 2 mol %.

In the application of the present invention, the following known fading preventive agents can be additionally used, and the dye stabilizers used in the present invention can be used alone or in combination. As known fading preventive agents can be mentioned, for example, hydroquinone derivatives described in U.S. Pat. Nos. 2,360,290, 2,418,613, 2,675,314, 2,701,197, 2,704,713, 2,728,659, 2,732,300, 2,735,765, 2,710,801, and 2,816,028, British Pat. No. 1,363,921, etc., gallic acid derivatives described in U.S. Pat. Nos. 3,457,079, and 3,069,262, etc., p-alkoxyphenols described in U.S. Pat. Nos. 2,735,765 and 3,698,909, Japanese Patent Publication Nos. 20977/1974 and 6623/1977, p-oxyphenol derivatives described in U.S. Pat. Nos. 3,432,300, 3,573,050, 3,574,627 and 3,764,337, Japanese patent application (OPI) Nos. 35633/1977, 14743/1977 and 152225/1977 and bisphenols described in U.S. Pat. No. 3,700,455.

To introduce a dye stabilizer of the present invention into a photographic layer of color photosensitive material, the compound can be added, for example, without being emulsified, directly to a silver halide emulsion or to a mixture solution of a coupler dispersion by dissolving into a low boiling point organic solvent such as ethyl acetate or ethanol to be emulsified. However, it is desirable that a dye stabilizer of the present invention is dissolved together with a coupler into a high boiling point solvent such as dibutylphthalate and tricresyl phosphate if desired, in the presence of a low boiling point co-solvent, to be used as an emulsified dispersion wherein the compound is emulsified and dispersed in an oil droplet in a water-soluble protective colloid such as gelatin or the like. Alternatively only a dye stabilizer of the present invention is emulsified and the emulsion together with a coupler dispersion is added to a silver halide emulsion.

Photographic layers to which a dye stabilizer of the present invention will be added include a coupler-containing silver halide photosensitive emulsion layer (e.g., a red-sensitive silver halide emulsion layer, a green-sensitive silver halide emulsion layer and a blue-sensitive silver halide emulsion layer), a non-photosensitive photographic auxiliary layer (e.g., a protective layer, a filter layer, an intermediate layer, a subbing layer, etc.), although the dye stabilizer of the present invention is preferably placed in a magenta coupler-containing photographic layer, that is, the dye stabilizer is particularly effective to prevent a magenta image from fading or discoloring.

Typical examples of high boiling point organic solvents used in dissolving the dye stabilizers of the present invention alone or in combination with a coupler are butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate, trioctadecyl phosphate, etc. described in U.S. Pat. No. 3,676,137, diethyl succinate, dioctyl adipate, 3-ethylbiphenyl, and liquid dye stabilizers described in Product Licensing Index, Vol. 83, pages 26–29 (March 1971) under the name of "improved photographic dye image stabilizers."

Examples of low boiling point organic solvents used as co-solvents with a high boiling point organic solvent are ethyl acetate, butyl acetate, ethyl propionate, ethyl formate, butyl formate, nitroethane, carbon tetrachloride, chloroform, hexane, cyclohexane, ethylene glycol, acetone, ethanol, dimethylformamide, dioxane, etc. to which benzene, toluene, xylene or the like may be added.

Examples of surface active agents used in dispersing a solution containing the dye stabilizer used in the present invention alone or in combination with a coupler into an aqueous protective colloid include saponin, sodium alkyl sulfosuccinates, sodium alkyl benzenesulfonates, etc. and as examples of hydrophilic protective colloids can be mentioned gelatin (lime gelatin and gelatin treated with an acid can be used), casein, carboxymethylcellulose, polyvinyl alcohol, polyvinyl pyrrolidone, styrene-maleic anhydride copolymer, a condensate of styrene-maleic anhydride copolymer with polyvinyl alcohol, polyarcrylates, ethylcellulose, etc., but the invention is not limited to those.

Bases used for the present invention include a cellulose nitrate film, cellulose acetate film, cellulose acetate butylate film, cellulose acetate propionate film, polystyrene film, polyethylene terephthalate film and polycarbonate film, a base laminated with a film, thin glass film, paper, etc. which are used generally for photographic materials. Baryta paper or papers to which $\alpha$-olefin polymer, particularly a polymer of $\alpha$-olefin having 2 to 10 carbon atoms for example polyethylene, polypropylene, ethylene/butene copolymer, etc. is applied or laminated bases and plastic films, in which the surface is roughened as described in Japanese Patent Publication No. 19068/1972 so as to render the adhesion to other high polymers improved, will give a favorable result.

Of these bases, a transparent one or opaque one is selected depending on the photosensitive material. A dye or pigment may be added to color the base.

Examples of the opaque bases include opaque materials by nature such as paper, materials in which transparent films are coated with pigments such as dyes or titanium oxide, plastic films which have been subjected to a surface processing in a manner described in Japanese Patent Publication No. 1906/1972, and paper as well as plastic films in which carbon black, a dye or the like is blended so as to obtain a perfect light shielding property. The base is usually provided with a primer coat. For the purpose of further improving adhesion properties of the base surface, preliminary treatment may be carried out thereon by corona discharge, ultraviolet irradiation, flame treatment or the like.

In the practice of the present invention, it is preferred, as usual, to form an ultraviolet ray absorbing layer additionally on the surface of a photographic light-sensitive emulsion layer which is an image forming layer, since the absorbing layer is effective to prevent an image from discoloration or fading by light.

Further, the present invention is not limited with respect to the kinds of color processing agents such as a color developing agent, a bleaching agent and a fixer which are conventionally used. In particular, a silver saving type color photographic material disclosed in U.S. Pat. No. 3,902,905 can be applied advantageously to the present invention. Additionally in the present invention, no limitation is put on any kinds of intensification agents for color intensification processing.

The color photographic materials which the present invention can apply include the usual color light-sensitive materials, particularly color photographic paper. In the present invention, there may be applied color photographic systems, particularly color diffusion transfer photographic systems disclosed in U.S. Pat. Nos. 3,227,550, 3,227,551 and 3,227,552, and U.S. Provisional Publication Patent U.S., B 351,673.

In order to obtain dye image of the color photographic material of the present invention, the photographic material must be subjected to color photographic development treatment after an exposure step. The color photographic development treatment is composed basically of a color development, a bleaching process and a fixing step. The two steps of the latter can be carried out at a time. Alternatively, an order of the color development, a first fixing process and a bleaching/fixing process is practicable. The development treatment step, if desired, may comprise a combination of steps of prehardening bath, neutralizer bath, a first development (black and white development) bath, image stabilizing bath and washing. Processing temperature is 18° C. or more in many cases. The processing temperature often used is within the range of 20° to 60° C., in recent years particularly within the range of 30° to 60° C.

The color developing solution is an aqueous alkaline solution containing an aromatic primary amine color developing agent and having a pH of 8 or more, preferably a pH of 9 to 12. Typical and preferably examples of the above color developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfoamidoethyl-N,N-diethylaniline and their salts (e.g., sulfates, hydrochlorides, sulfites, p-toluene sulfonates and the like). Other usable color developing agents are disclosed in U.S. Pat. Nos. 2,193,015 and 2,592,364, Japanese patent application (OPI) No. 64933/1973 and L. F. A. Mason, "Photographic Processing Chemistry", Focal Press London, 1966, p. 22–229.

The color developing solution, in addition, can contain a pH buffer such as a sulfite, a carbonate, a borate or a phosphate of an alkaline metal, as well as a development restrainer or an antifoggant such as a bromide, an iodide or an organic antifoggant.

Specific examples of antifoggants used in the present invention include potassium bromide, potassium iodide; nitrobenzimidazoles, mercaptobenzimidazole, 5-methyl-benztriazole and 1-phenyl-5-mercaptotetrazole disclosed in U.S. Pat. Nos. 2,496,940 and 2,656,271; compounds disclosed in U.S. Pat. Nos. 3,113,864, 3,342,596, 3,295,976, 3,615,522 and 3,597,199; thiosulfonyl compounds disclosed in British Pat. No. 972,211; phenazine-N-oxides disclosed in Japanese Patent Publication No. 41675/1971, and antifoggants disclosed in Kagaku Shashin Benran (Science Photographic Handbook), Middle Volume, P. 29–47.

Moreover, the color developing solution may contain, if necessary, a water softener, a preservative such as hydroxylamine or DABCO (1,4-diazabicyclo [2,2,2] octane), an organic solvent such as benzyl alcohol or diethylene glycol, a development accelerator such as a polyethylene glycol, a quaternary ammonium salt or an amine, a dye forming coupler, a competing coupler, a fogging agent such as sodium borohydride, an auxiliary developing agent such as 1-phenyl-3-pyrazolidone and a viscosity imparting agent.

The color photographic material of the present invention is subjected to the usual color development, but in the present invention, the following color intensification development technique can be applied: For example, a method of using peroxides disclosed in U.S. Pat. Nos. 3,674,490 and 3,761,265, West German patent application (OLS) No. 2,056,360, Japanese patent application (OPI) Nos. 6338/1972, 10538/1972, 13335/1977, 13334/1977 and 13336/1977; another method of using cobalt complexes disclosed in West German patent application (OLS) No. 2,226,770, Japanese patent application (OPI) Nos. 9728/1973, 9729/1973, 6026/1976, 94822/1976, 133023/1976, 7728/1977 and 11034/1977; and still another method of using chlorous acid disclosed in Japanese Patent Publication No. 14625/1977, Japanese patent application (OPI) Nos. 99022/1976 and 103430/1976.

After the color development, the photographic emulsion layer is usually subjected to bleaching. The bleaching may be carried out simultaneously with fixing or separately therefrom. Usable examples of bleaching agents include compounds of polyvalent metals such as iron (III), cobalt (III), chromium (VI) and copper (II), peracids, quinones and nitroso compounds. Examples of the bleaching agents include ferricyanides, dichromates, organic complexes of iron (III) and cobalt (III); for examples, complexes of aminopolycarboxylic acids such as ethylenediaminetetraacetic acid, nitrilotriacetic acid, 1,3-diamino-2-propanoltetraacetic acid; complexes of organic acids such as citric acid, tartaric acid and malic acid; persulfates and permanganates; and nitrosophenols. Of these compounds, potassium ferricyanide, iron (III) sodium ethylenediaminetetraacetate and iron (III) ammonium ethylenediaminetetraacetate are particularly useful. (Ethylenediaminetetraacetato) iron (III) complex is useful in an independent bleaching bath and in one bleaching/fixing bath.

The bleach-fix processing can be carried out at an arbitrary temperature of 18° to 50° C., but its processing temperature preferably is 30° C. or over. When it is at a level of 35° C. or over, the processing time can be shortened up to 1 minute or less, and a supplemetary amount of a liquid can be reduced. The time necessary for washing after the bleach-fix step is usually 3 minutes or less, but when a stabilizing bath is employed, such a washing operation is not substantially required.

To the bleaching bath or the bleach-fix bath, a bleach accelerator and other various additives can be added which are disclosed in U.S. Pat. Nos. 3,042,520 and 3,241,966 as well as Japanese Patent Publication Nos. 8506/1970 and 8836/1970.

In the silver halide color photographic material of the present invention, a color image thereon does not discolor for a long period of time, and a white background on the color image can be prevented from causing yellow stain. Therefore, it is fair to say that the silver halide color photographic material of the present invention has an excellent and high preservability.

In the color photographic material of the present invention, the discoloration inhibitor does not cause any change in a hue and any photographic fog, and has an effect sufficient to prevent a dye image from changing and discoloring.

Now, the present invention will be described in detail in accordance with examples, but the latter do not intend to limit the scope of the present invention.

EXAMPLE 1

In a solution of 20 ml of tricresyl phosphate and 20 ml of ethyl acetate was dissolved 10 g of Magenta coupler M-1, and the resulting solution was emulsified and dispersed in 80 g of a gelatin solution containing 8 ml of a 1% aqueous sodium dodecyl-benzenesulfonate.

This resultant emulsified dispersion was mixed with 145 g of a green-sensitive silver chlorobromide emulsion (Br content 50 mol %, Ag content 7 g), and sodium dodecylbenzene-sulfonate as a coating auxiliary was added thereto. A paper base both the surfaces of which had previously been laminated with a polyethylene film was coated with the resulting mixture.

A coating amount of the coupler was 400 mg/m$^2$. Then, a gelatin protective layer (gelatin contant 1 g/m$^2$) was provided over this layer in order to form a sample A.

In the similar manner, emulsified dispersions were prepared each of which was composed of a combination of Magenta coupler M-17, M-23 or M-31 and a compound having a general formula (I) or (II) or a comparative compound. The compound represented by the general formula (I) or (II) or the comparative compound was added in an amount of 50 mol % with respect to the coupler employed, and the same procedure as in the case of preparing the Sample A was repeated with the exception that stabilizers were exchanged, in order to prepare samples B to T.

These samples were exposed to a light of 1,000 lux for one second and were then treated with the following processing solution:

| Developing solution | |
|---|---|
| Benzyl alcohol | 15 ml |
| Diethylenetriaminepentaacetic acid | 5 g |
| KBr | 0.4 g |

-continued

| Developing solution | |
|---|---|
| $Na_2SO_3$ | 5 g |
| $Na_2CO_3$ | 30 g |
| Hydroxylamine sulfate | 2 g |
| 4-Amino-3-methyl-N—ethyl- N—β-(methane-sulfonamido)-ethylaniline.3/2$H_2SO_4$.$H_2O$ | 4.5 g |
| Water | q.s. 1,000 ml |
| (pH = 10.1) | |

| Bleach-fix Solution | |
|---|---|
| Ammonium thiosulfate (70 wt %) | 150 ml |
| $Na_2SO_3$ | 5 g |
| Na[Fe(EDTA)] | 40 g |
| EDTA | 4 g |
| Water | q.s. 1,000 ml |
| (pH = 6.8) | |

| Processing Conditions | Temperature | Time |
|---|---|---|
| Developing solution | 33° C. | 3 min 30 sec |
| Bleach-fix solution | 33° C. | 1 min 30 sec |
| washing | 28 to 35° C. | 3 min |

For each sample formed with a dye image thereon, a fading test was carried out for 6 days by the use of a xenon tester (illumination 200,000 lux) with an ultraviolet absorbing filter (Produced by Fuji Photo Film) for cutting off a wave range of 400 nm and less. A density variation of each sample at the portion having an initial density of 2.0 was measured by a Macbeth densitometer RD-514 model (Status AA Filter), and the results are set forth in Table 1.

TABLE 1

| Sample | Magenta Coupler | Dye Stabilizer | Variation in Magenta Density (Initial Density 2.0) | Remarks |
|---|---|---|---|---|
| A | M-1 | — | −1.73 | Comparative example |
| B | M-1 | Comparative compound (A) | −0.32 | Comparative example |
| C | M-1 | Comparative compound (B) | −0.49 | Comparative example |
| D | M-1 | Comparative compound (C) | −0.51 | Comparative example |
| E | M-1 | Compound (18) | −0.22 | This invention |
| F | M-1 | Compound (19) | −0.21 | This invention |
| G | M-17 | — | −1.98 | Comparative example |
| H | M-17 | Comparative compound (A) | −0.69 | Comparative example |
| I | M-17 | Comparative compound (B) | −0.65 | Comparative example |
| J | M-17 | Comparative compound (C) | −0.69 | Comparative example |
| K | M-17 | Compound (4) | −0.19 | This invention |
| L | M-17 | Compound (6) | −0.23 | This invention |
| M | M-23 | — | −1.75 | Comparative example |
| N | M-23 | Compound (1) | −0.22 | This invention |
| O | M-23 | Compound (11) | −0.24 | This invention |
| P | M-23 | Compound (39) | −0.34 | Comparative example |
| Q | M-31 | — | −1.83 | Comparative example |
| R | M-31 | Compound (7) | −0.24 | This invention |
| S | M-31 | Compound (12) | −0.23 | This invention |
| T | M-31 | Compound (37) | −0.21 | This invention |

Comparative Compound (A)

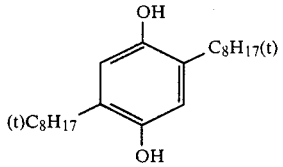

Compound described in U.S. Pat. No. 3,764,337

Comparative Compound (B)

TABLE 1-continued

| Sample | Magenta Coupler | Dye Stabilizer | Variation in Magenta Density (Initial Density 2.0) | Remarks |
|---|---|---|---|---|

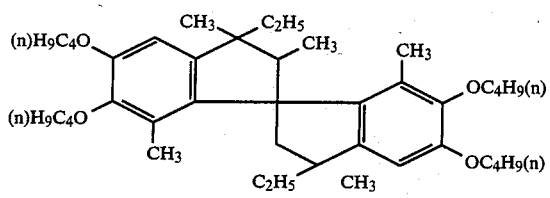

Compound described in U.S. Pat. No. 4,360,589
Comparative Compound (C)

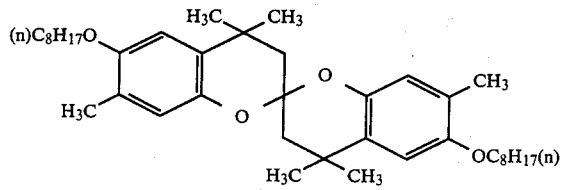

Compound described in U.S. Pat. No. 4,174,220

EXAMPLE 2

By the use of Magenta coupler M-25, a coating composition for a third layer in Table 3 was prepared in accordance with the same procedure as in the case of preparing the sample A in Example 1. Using the coating composition in the third layer, multi-layer sample having structure shown in Table 3 was prepared. On the other hand, in the same manner as the above five pieces of multi-layer samples b to f containing dye stabilizers of the present invention shown in Table 2 and/or comparative compounds in the third layer were prepared. These samples were exposed to a light and processed as in Example 1. The developed dye images of the respec- of each sample at the portion having an initial density of 1.0 was measured. The results are set forth in Table 2.

These results indicate that the compounds of the present invention have the great effect that the dye images are prevented from fading by light.

On the other hand, after these samples were subjected to another blue-green-red tri-color separation exposure, the same processing as in Example 1 was carried out. Then, their hues of the magenta colors were compared with each other, and it was found that the samples b to d formed all the same excellent hues as that of the sample a. This fact elucidated that the addition of the compounds regarding the present invention has no influence on the hue at all.

TABLE 2

| Sample | Dye Stabilizer | Amount (mol %/coupler) | Variation in Magenta Density (Initial Density = 1.0) | Remarks |
|---|---|---|---|---|
| a | — | — | −0.44 | Comparative example |
| b | Compound (4) | 50 | −0.15 | This invention |
| c | Compound (4) | 100 | −0.09 | This invention |
| d | Compound (4) | 100 | −0.06 | This invention |
| | Comparative compound (D) | 5 | | |
| e | Comparative compound (B) | 100 | −0.29 | Comparative example |
| f | Comparative compound (C) | 100 | −0.29 | Comparative example |

Comparative compound (D)

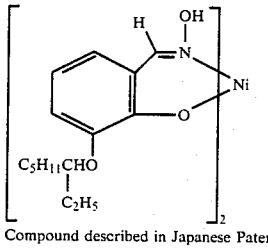

Compound described in Japanese Patent Application (OPI) No. 97353/1985

TABLE 3

| | |
|---|---|
| Seventh Layer | gelatin (coating amount 1,600 mg/m$^2$) |
| Sixth layer | gelatin (coating amount 1,000 mg/m$^2$) |

TABLE 3-continued

| | |
|---|---|
| | ultraviolet absorbing agent (*1) (coating amount 360 mg/m$^2$) ultraviolet absorbing solvent (*2) (coating amount 120 mg/m$^2$) |
| Fifth layer | silver chlorobromide emulsion (Br 50 mol%, silver coating amount 250 mg/m$^2$), gelatin (coating amount 1,200 mg/m$^2$), cyan coupler (*3) (coating amount 500 mg/m$^2$) coupler solvent (*2) (coating amount 250 mg/m$^2$) |
| Fourth Layer | gelatin (coating amount 1,600 mg/m$^2$) ultraviolet absorbing agent (*1) (coating amount 700 mg/m$^2$) color mixing inhibitor (*4) (coating amount 200 mg/m$^2$) solvent (*2) (coating amount 300 mg/m$^2$) |
| Third Layer | silver chlorobromide emulsion (Br 50 mol %, silver coating amount 180 mg/m$^2$) magenta coupler (*5) (coating amount 320 mg/m$^2$), coupler solvent (*6) (coating amount 320 mg/m$^2$) |
| Second layer | gelatin (coating amount 1,100 mg/m$^2$) color mixing inhibitor (*4) (coating amount 200 mg/m$^2$) solvent (*2) (coating amount 100 mg/m$^2$) |
| First Layer | silver chlorobromide emulsion (Br 80 mol %, silver coating amount 350 mg/m$^2$), gelatin (coating amount 1,500 mg/m$^2$), yellow coupler (*7) (coating amount 500 mg/m$^2$) coupler (*8) (coating amount 400 mg/m$^2$) |
| Base | paper base both the surfaces of which were laminated with a polyethylene film |

*1 Ultraviolet absorbing agent: 2-(2-hydroxy-3-sec-butyl-5-tert-butylphenyl)benzotriazole
*2 Solvent: dibutyl phthalate (UV-21)
*3 Cyan coupler: 2-[α-(2,4-di-tert-pentylphenoxy)-butaneamide]-4,6-dichloro-5-methylphenol
*4 Color mixing inhibitor: 2,5-dioctylhydroquinone
*5 Magenta coupler: M-25
*6 Coupler solvent: tricresyl phosphate
*7 Yellow coupler: α-pivaloyl-α-(2,4-dioxo-5,5'-dimethyloxazoline-3-yl)-2-chloro-5-[α-(2,4-di-tert-pentylphenoxy)butaneamide]acetoanilide
*8 Coupler solvent: dioctylbutyl phosphate

TABLE 4

| Sample | Antioxidant | Dye Residual Percentages after 500 hours' Xenon Exposure | Dye Residual after Percentages 100 hours' Storage at 100° C. | Remarks |
|---|---|---|---|---|
| g | — | 59% | 52% | Blank |
| h | Compound (17) | 79% | 76% | This invention |
| i | Compound (34) | 83% | 77% | This invention |
| j | Comparative compound (E) | 63% | 59% | Comparative example |
| k | 2,2,6,6-tetramethyl-4-piperidinol** | 61% | 56% | Comparative example |

Comparative Compound (E)

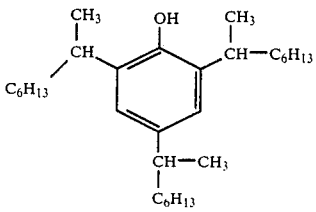

Compound described in Japanese Patent Publication No. 31626/1973
**Compound described in Japanese Patent Publication No. 20974/1974

EXAMPLE 3

A sample g was prepared by the same procedure as in Example 1 with the exception that the magenta coupler of the sample A in Example 1 was replaced with Cyan coupler C-1 and that the green-sensitive silver chlorobromide emulsion was replaced with a red-sensitive silver chlorobromide (Br content 50 mol %).

Other samples were similarly prepared by adding a dye stabilizer in an amount of 50 mol % based on the coupler. Exposure and development were carried out in the same manner as in Example 1.

For each sample formed with a dye image thereon, fastness to light was inspected by exposing the sample for 500 hours by the use of a xenon tester (illumination 100,000 lux) with an ultraviolet absorbing filter (Produced by Fuji Photo Film) for cutting off a wave range of 400 nm and less. After the exposure, for the samples at the portion having an initial density of 2.0, dye residual percentages were measured.

Further, for the inspection of heat resistance, samples were stored in a dark place at 100° C. for 100 hours, and dye residual percentages at the portion having an initial density of 2.0 were then measured.

EXAMPLE 4

A sample l was prepared by the same procedure as in Example 1 with the exception that the magenta coupler of the sample A in Example 1 was replaced with Yellow coupler Y-35 and that the green-sensitive silver chlorobromide emulsion was replaced with a blue-sensitive silver chlorobromide (Br content 80 mol %). Other samples m~p were similarly prepared by adding a dye stabilizer in an amount of 50 mol % based on the coupler.

Exposure and development were carried out in the same manner as in Example 1.

For the inspection of fastness to light, a xenon tester was used as in Example 3. That is, the samples at the portion having a dye initial density of 2.0 were exposed to light and then dye residual percentages were measured. Further, for the inspection of heat resistance, the samples were stored in a dark place at 100° C. for 500 hours and then dye residual percentages at the portion having an initial concentration of 2.0 were measured. The results are set forth in Table 5.

TABLE 5

| Sample | Antioxidant | Dye Residual Percentages after 200 hours' Xenon Exposure | Dye Residual Percentages after 500 hours' Storages at 100° C. | Remarks |
|---|---|---|---|---|
| l | — | 72% | 90% | Blank |
| m | Compound (12) | 89% | 96% | This invention |
| n | Compound (35) | 88% | 94% | This invention |
| o | Comparative compound (E) | 74% | 90% | Comparative example |
| p | 2,2,6,6-tetramethyl-4-piperidinol** | 72% | 91% | Comparative example |

Comparative compound (E)

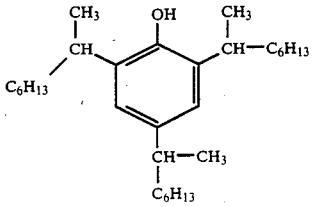

Compound described in Japanese Patent Publication No. 31626/1973
**Compound described in Japanese Patent Publication No. 20974/1974

As is apparent from the above results in Examples 1 to 4, the effect of improving fastness of the dye image with respect to cyan, magenta and yellow are superior to that of known compounds having similar chemical structures. Particularly with respect to the cyan and the yellow dye images, a heat-resistant fastness is also excellent in the present invention.

Having described our invention as related to the embodiment, it is our intention that the invention not be limited by any of the details of the description, unless otherwise specified, but rather be construed broadly within its spirit and scope as set out in the accompanying claims.

What we claim is:

1. A silver halide color photographic material, comprising at least one compound represented by formula (I) in a coupler containing layer:

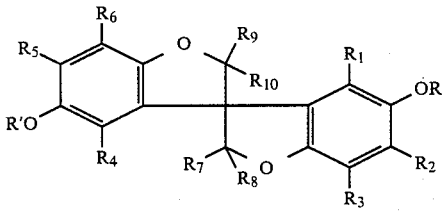

wherein R and R', which may be the same or different, each represents a hydrogen atom, alkyl group, alkenyl group, aryl group, heterocyclic ring group, $R_{11}CO$—, $R_{12}SO_2$—, $R_{13}NHCO$— in which $R_{11}$, $R_{12}$ and $R_{13}$ each represents an alkyl group, alkenyl group, aryl group, heterocyclic group, or silyl group; $R_1$, $R_2$, $R_3$, $R_4$, $R_5$ and $R_6$, which may be the same or different, each represents a hydrogen atom, halogen atom, alkyl group, alkenyl group, alkoxy group, alkenoxy group, aryloxy group, alkylthio group, alkenylthio group, arylthio group, alkoxycarbonyl group, alkylcarbonyl group, hydroxy group, alkylcarbonyl group, carbamoyl group or acylamino group; $R_7$, $R_8$, $R_9$ and $R_{10}$, each represents a hydrogen atom; R and $R_1$ may be joined together to form a 5 or 6-membered ring, and R' and $R_4$ may be joined together to form a 5 or 6-membered ring.

2. The silver halide color photographic material as claimed in claim 1, wherein in formula (I), R and R' each represents a hydrogen atom or alkyl group.

3. The silver halide color photographic material as claimed in claim 1, wherein $R_1$, $R_2$, $R_3$, $R_4$, $R_5$ and $R_6$ each represents a group selected from a hydrogen atom, halogen atom, alkyl group, alkoxy group, alkylthio group and acylamino group.

4. The silver halide color photographic material as claimed in claim 1, wherein the compound represented by formula (I) is used in combination with at least one of hydroquinone derivatives, hydroxychroman derivatives, or hydroxyspirochroman derivatives.

5. The silver halide color photographic material as claimed in claim 1, wherein a dye stabilizer of formula (I) is present in an amount of 0.5 to 200 wt. % based on a coupler.

6. The silver halide color photographic material as claimed in claim 1, further comprising at least one coupler represented by formula (II), (III), (IV), (V) or (VI)

formula (II)

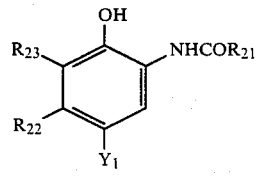

formula (III)

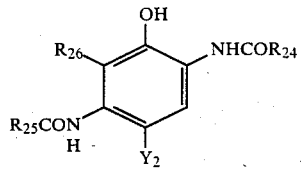

-continued

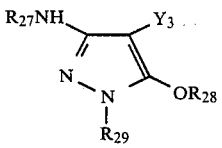

formula (IV)

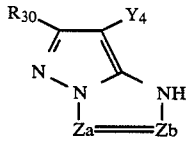

formula (V)

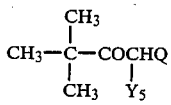

formula (VI)

wherein $R_{21}$, $R_{24}$ and $R_{25}$ each represents an aliphatic group, aromatic group, heterocyclic group, aromatic amino group, or heterocyclic amino group; $R_{22}$ represents an aliphatic group; $R_{23}$ and $R_{26}$ each represents a hydrogen atom, halogen atom, aliphatic group, aliphatic oxy group or acylamino group; $R_{27}$ and $R_{29}$ each represents a substituted or unsubstituted phenyl group; $R_{28}$ represents a hydrogen atom, aliphatic acyl group, aromatic acyl group, aliphatic sulfonyl group or aromatic sulfonyl group; $R_{30}$ represents a hydrogen atom or a substituent; Q represents a substituted or unsubstituted N-phenylcarbamoyl group; Za and Zb each represents a methine group, substituted methine group or =N—; $Y_1$, $Y_2$, $Y_3$, $Y_4$ and $Y_5$ each represents a group capable of splitting off at the time of coupling reaction with an oxidation product of a developing agent; and in formulas (II) and (III), $R_{22}$ and $R_{23}$, and $R_{25}$ and $R_{26}$, respectively, may form a 5, 6 or 7 membered ring.

7. The silver halide color photographic material as claimed in claim 6, wherein the coupler is selected from the compound represented by formulas (IV) and (V).

8. The silver halide color photographic material as claimed in claim 1, wherein the number of carbon atoms of the alkyl group or alkenyl group in each of R, R' and $R_1$ to $R_6$ is 1 to 20.

9. The silver halide color photographic material as claimed in claim 1, wherein R and R' each represent an alkyl group selected from the group consisting of methyl, ethyl, propyl, n-octyl, tert-octyl, and hexadecyl, alkenyl group selected from the group consisting of allyl, octenyl and oleyl, aryl group selected from the group consisting of phenyl and naphthyl, heterocyclic ring selected from the group consisting of tetrahydrophranyl and pyrimidyl, $R_{11}CO$, $R_{12}SO_2$ or $R_{13}NHCO$ in which $R_{11}$, $R_{12}$ and $R_{13}$ each represent an alkyl group selected from the group consisting of methyl, ethyl, n-propyl, n-butyl, n-octyl, tert-octyl and benzyl, alkenyl group selected from the group consisting of allyl, octenyl and oleyl, aryl group selected from the group consisting of phenyl, methoxyphenyl and naphthyl, heterocyclic ring selected from the group consisting of pyridyl and pyrimidyl, or a silyl group selected from the group consisting of trimethylsilyl, dimethylphenylsilyl, dimethyl-t-butylsilyl and triphenylsilyl.

10. The silver halide color photographic material as claimed in claim 1, wherein $R_1$, $R_2$, $R_3$, $R_4$, $R_5$ and $R_6$, which may be the same or different, each represents a halogen atom selected from the group consisting of fluorine, chlorine and bromine, alkyl group selected from the group consisting of methyl, ethyl, and n-butyl, alkenyl group selected from the group consisting of allyl, hexenyl and octenyl, alkoxy group selected from the group consisting of methoxy, ethoxy and benzyloxy, alkenoxy selected from the group consisting of 2-propenyloxy and hexenyloxy, aryloxy group selected from the group consisting of phenyloxy and naphthyloxy, alkylthio group selected from the group consisting of ethylthio and butylthio, alkenylthio group selected from the group consisting of 2-butenylthio and 2-pentenylthio, arylthio group selected from the group consisting of phenylthio and naphthylthio, alkoxycarbonyl group selected from the group consisting of methoxycarbonyl group and butoxycarbonyl group, alkylcarbonyl group selected from the group consisting of acetyl and tetradecanoyl, alkylcarbonyloxy group selected from the group consisting of acetyloxy and tetradecanoyloxy, carbamoyl group selected from the group consisting of N-ethylcarbamoyl and N-methyl-N-dodecylcarbamoyl or acylamino group selected from the group consisting of acetylamino and benzamino.

11. The silver halide color photographic material as claimed in claim 7, wherein the coupler is present in an amount of $2\times10^{-3}$ to $5\times10^{-1}$ mol per mol of silver.

12. The silver halide color photographic material as claimed in claim 1, wherein the compound of formula (I) is dissolved together with a coupler into a high boiling solvent in the presence of a low boiling point cosolvent, wherein the compound is emulsified and dispersed in an oil droplet in a water-soluble protective colloid.

13. The silver halide color photographic material as claimed in claim 1, wherein the compound of formula (I) is emulsified and the emulsion together with a coupler dispersion is added to a silver halide emulsion.

14. The silver halide color photographic material as claimed in claim 1, wherein the compound of formula (I) is present in a magenta coupler containing photographic layer.

* * * * *